United States Patent [19]

Takeda et al.

[11] 4,254,214

[45] Mar. 3, 1981

[54] PHOTOGRAPHIC MATERIALS FOR NON-SILVER IMAGES AND PROCESS FOR FORMING NON-SILVER IMAGES

[75] Inventors: Keizi Takeda; Kenji Matsumoto; Masayoshi Nagata, all of Asaka, Japan

[73] Assignee: Fuji Photo Film Co., Ltd., Minami-ashigara, Japan

[21] Appl. No.: 910,936

[22] Filed: May 30, 1978

Related U.S. Application Data

[63] Continuation of Ser. No. 745,908, Nov. 29, 1976, abandoned.

[30] Foreign Application Priority Data

Nov. 27, 1975 [JP] Japan ..... 50-142077
Feb. 10, 1976 [JP] Japan ..... 51-13797

[51] Int. Cl.[3] ..... G03C 5/24

[52] U.S. Cl. ..... 430/415; 430/416; 430/523

[58] Field of Search ..... 96/76 R, 48 PD, 60 R, 96/61; 430/415, 416, 421, 428, 564, 523, 414

[56] References Cited

U.S. PATENT DOCUMENTS

| | | | |
|---|---|---|---|
| 3,219,444 | 11/1965 | Valle et al. | 96/94 BF |
| 3,512,972 | 5/1970 | Case | 96/48 PD |
| 3,565,622 | 2/1971 | Sincius | 96/48 R |
| 3,655,383 | 4/1972 | Sheppard et al. | 96/48 PD |
| 3,674,489 | 7/1972 | Wyman | 96/48 PD |
| 3,730,721 | 5/1973 | Williams et al. | 96/60 R |
| 3,839,038 | 10/1974 | Gracia et al. | 96/48 PD |
| 3,843,363 | 10/1974 | Lehman | 96/48 PD |
| 3,860,500 | 1/1975 | Gysling | 96/48 PD |

*Primary Examiner*—Won H. Louie, Jr.
*Attorney, Agent, or Firm*—Sughrue, Rothwell, Mion, Zinn and Macpeak

[57] ABSTRACT

A photographic material for recording non-silver images at high sensitivity using a small amount of silver halide, comprising a support, a layer, formed thereon, of a monovalent or divalent copper salt or complex and a hydrophilic binder, and a layer of silver halide formed on the layer containing the copper salt or complex either by vacuum-deposition or sputtering, or by coating a silver halide emulsion. Non-silver images are formed by exposing the photographic material imagewise, and developing the silver halide layer and the copper compound layer either successively with different developer solutions, or continuously in one developer solution. The silver developed acts as a catalyst for the development of the copper compound.

22 Claims, No Drawings

PHOTOGRAPHIC MATERIALS FOR NON-SILVER IMAGES AND PROCESS FOR FORMING NON-SILVER IMAGES

This is a continuation of application Ser. No. 745,908 filed Nov. 29, 1976, now abandoned.

BACKGROUND OF THE INVENTION

1. Field of the Invention

This invention relates to a photographic material and a process for forming images, and more specifically, to a photographic material and a process for recording non-silver images at high sensitivity using a small amount of silver halide.

2. Description of the Prior Art

Conventional silver halide photographic methods and silver halide diffusion transfer methods have heretobefore been used widely as high-speed photographic processes. Silver halide photographic methods are described in detail, for example, in C. E. K. Mees and T. H. James, *The Theory of the Photographic Process*, MacMillan, New York, (1966), and silver halide diffusion transfer methods are described in A. Rott and E. Weyde, *Photographic Silver Halide Diffusion Processes*, The Focal Press, London and New York, (1972). A photographic material having a somewhat high sensitivity was developed and is comercially available under the trademark "DRY SILVER" (Minnesota Mining & Manufacturing Co.). This technique is described in detail in U.S. Pat. Nos. 3,152,903, 3,152,904, and 3,457,075.

These photographic processes have their own characteristics such as high speed, high quality, rapid processing, or dry processing, but they generally require large amounts of silver because silver compounds are used as the photosensitive substance and as the image-forming substance (or as an intermediate medium for color image formation in the case of silver halide color photographic processes). The recovery and re-use of silver are performed only in some of these processes because of the need for equipment, for example. This generally renders these photographic processes expensive. Furthermore, since concern exists as to the scarcity of silver resources, this is a disadvantage of photographic processes using silver.

Thus, development of photoraphic processes using low amounts of silver, or of non-silver photographic processes using no silver is necessary. A number of non-silver photographic processes have been reported (e.g., as described in J. Kosar, *Light-sensitive Systems*, John Wiley & Sons, New York, (1965)), but they generally have a much lower sensitivity than photographic processes using silver.

A physical developing method using a non-silver metallic ion is known as an example of a method for forming images by using a non-silver metal together with a small amount of a silver compound or non-silver compound as a photosensitive component or catalyst component. This method comprises exposing a sheet containing a small amount of a silver or non-silver compound as a photosensitive substance to form a development nucleus either directly, or indirectly by a subsequent treatment, or deactivating an active development nucleus initially present by exposure, and then dipping the sheet containing the development nucleus in a solution (physical development solution) composed of a non-silver metal ion (image-forming substance) and a reducing agent, etc. thereby selectively reducing the non-silver metal ion on the development nucleus and depositing the resulting metal atom on the development nucleus to form a non-silver metal image. The development nucleus is formed by various methods, for example, a method comprising exposing a photo semiconductor such as titanium dioxide and then resulting it with a silver ion or palladium ion to form a silver nucleus or palladium nucleus a method comprising exposing a diazonium compound to cause cis/trans isomerization, and reducing silver and a mercury ion with the isomerization product to form a silver amalgam nucleus, a method comprising exposing a photo-reducible dye and reducing silver ion, etc. with the resulting reducing agent to form a silver nucleus, etc., and a method comprising photo-decomposing a photosensitive noble metal compound such as a palladium compound to form a noble metal nucleus. On the other hand, copper, nickel, cobalt, and tin are known as examples of image-forming metals. The details of these physical development methods are described, for example, in U.S. Pat. Nos. 3,512,972, 3,893,856, 2,609,295, 2,733,144, 2,738,272, 2,750,292, 2,764,484, and 2,775,773, H. Jonker et al., *Photographic Science and Engineering*, Vol. 13, page 1 (1969), Vol. 13, page 33 (1969), Vol. 13, page 38 (1969), and Vol. 13, page 45 (1969), and H. Jonker et al., *Journal of Photographic Science*, Vol. 19, page 96 (1971). According to this photographic process, amplification is performed to some extent in the physical development step so that images can be recorded with a somewhat high sensitivity. However no method has ever been found in which developed silver directly formed from silver halide is used as a nucleus for the physical development of a non-silver metal. Accordingly, it is difficult to record images at high sensitivity comparable to that achieved with silver halide photography. The physical development method has other defects. For example, since a physical development solution containing both a reducible metallic ion as an image-forming substance and a reducing agent is generally unstable, the metallic ion tends to be reduced in the developer solution, and fog tends to occur. Moreover, the loss of the metallic ion is not small, and the used developer solution tends to cause pollution due to its heavy metal ion content.

Recently, photographic processes using photosensitive copper complexes were reported in U.S. Pat. Nos. 3,859,092, 3,860,500, 3,860,501 and 3,880,724. These processes involve exposing a sheet containing a certain monovalent or divalent copper ion complex, which is photosensitive to ultraviolet rays, to irradiation with ultraviolet rays, and then developing the exposed image by physical or chemical development to record a colored non-silver metal image. When images are to be obtained by physical development, these processes are not free from the various defects described above. But the characteristic of these processes is that images can be formed by chemical development (i.e., treatment with a reducing agent solution). In the case of chemical development, the element containing the copper complex is an "inner type" photographic material which both acts as a photosensitive component and an image forming component. However, since these processes are based on the utilization of the photosensitivity of the copper complex itself, image recording at the high speeds achieved in silver halide photographic materials is difficult. Furthermore, since this photographic material is not sensitive to visible light rays, it cannot be used for general photographic purposes.

SUMMARY OF THE INVENTION

Analysis and investigations on the defects of the various prior photographic processes, have been made along with extensive studies in order to develop a photographic process free from the above-mentioned defects. These investigations finally led to the accomplishment of the present invention.

A first object of this invention is therefore to provide a novel photographic material and a novel photographic process in which the silver content is drastically reduced as compared with conventional silver halide photographic materials, but with which, in spite of this, image recording at high speeds comparable to silver halide photography can be achieved.

A second object of the invention is to provide a photographic material and a photographic process for forming images from a non-silver metallic compound using metallic silver (developed silver) formed from a small amount of silver halide by exposure and development directly as a catalyst.

A third object of this invention is to provide a photographic material and a photographic process in which non-silver images are formed not by an "external type" physical development method, but by chemical development (i.e., treatment with a solution of a reducing agent) using an "inner type" photographic material containing a copper compound as an image-forming substance, thereby obviating the various defects of the physical development method (the lack of stability of the developer solution, the pollution problem caused by the waste solution, etc.).

A fourth object of the invention is to provide a photographic material and a photographic process in which a small amount of silver halide is used together with a copper complex sensitive only to ultraviolet rays thereby to render the photographic material sensitive both to ultraviolet rays and visible rays, with image recording being performed at high speeds.

It has now been found that when a layer of a small amount of fine colloidal silver (for example, vacuum deposited silver with a particle diameter of about 90 Å and an average thickness of about 10 Å is formed, in intimate contact, on an element comprising a support and a layer, formed thereon, of a dispersion of a monovalent or divalent copper salt or complex (to be referred to hereinafter simply as a copper compound) to be described in detail hereinbelow in a hydrophilic binder (e.g., cellulose acetate), and then the element is dipped in an alkaline aqueous solution containing a reducing agent (a chemical developer solution), only that part in which silver is present is colored black. It was further discovered that such a color formation occurs even when a small amount of metallic silver is dispersed in a hydrophilic binder layer formed on the layer containing the copper compound (preferably in an adjacent relationship) (for example, a layer in which developed silver resulting from a diluted silver halide emulsion is dispersed in gelatin) in addition to the case where colloidal silver contacts the surface of the layer containing the copper compound. In view of the fact that the color formation does not occur when the same element as described above but without any copper compound present is treated in the same way, the black substance is clearly formed from the copper compound and not from the metallic silver. In other words, a black non-silver image is formed from the copper compound by chemical development in the presence of a small amount of metallic silver. A chemical analysis showed that this black product was probably copper (II) oxide, or a mixture of it with metallic copper, but this in no way limits the present invention. Basically, the present invention is based on the discovery of the above surprising new phenomenon.

Thus, the non-silver image photographic material of this invention comprises a support, a layer containing a copper compound and a hydrophilic binder formed on the support, and a silver halide layer on top of the copper compound layer (preferably adjacent thereto, the silver halide layer comprising (1) a vacuum-deposited or sputtered silver halide layer or (2) a silver halide emulsion layer.

This invention in an additional embodiment provides a method of forming photographic images using this material by exposing this material imagewise, developing the silver halide (and, if desired, fixing it) to form developed silver, and subsequently dipping the material in a chemical developer solution (i.e., a reducing agent solution) thereby to develop a black non-silver image from the copper compound corresponding to the pattern of the developed silver at the exposed area and to form a permanent image. Alternatively, in a further embodiment the development of the silver halide and the development of the copper compound can be carried out continuously in one chemical developer solution. Thus, a positive image can be obtained from a negative original image.

DETAILED DESCRIPTION OF THE INVENTION

The detailed mechanism of the activity of developed silver at this time is not clear, but it is presumed that metallic silver becomes a catalytic development nucleus for the chemical development of the copper compound to convert the copper compound amplificatorily into a black substance.

In the present invention, the amount of metallic silver required for the formation of non-silver images (i.e., the amount of silver halide) is extremely small, and therefore, characteristic feature of the present invention is that photographic materials having a greatly reduced amount of silver and a photographic process using such a photographic material is provided. Even when the silver image obtained after the exposure and development of a vacuum-deposited or sputtered silver halide layer or a silver halide emulsion layer is exceedingly light in density, a non-silver image of high density can be obtained. Another important feature of the invention is that despite the fact that the photographic material of the invention is basically a photographic material which yields non-silver images, the images can be recorded at high speeds comparable to conventional silver halide photographic processes. This is because intensification is effected both in the step of developing the silver halide and the step of forming the non-silver image from the copper compound in the presence of the developed silver.

The image-forming process of this invention can be considered analogous in mechanism of image formation to known copper ion physical development processes ("exterior type"). The physical development process comprises forming a development nucleus (latent image) composed of an aggregate of atoms of silver or another element by the action of light with or without a post-treatment, and dipping it in a physical development solution composed of a copper ion and a reducing agent, etc. to deposit metallic copper on the development nucleus. According to the process of the present invention, a copper compound as an image-forming material is present in advance in the photographic material, and at the time of development, only a reducing agent is provided by the developer solution.

The mechanism of the development process in the process of this invention is not clear. If it takes the form of solution physical development, the process of this invention may seem to be an "inner type" version of the conventional physical development process. However, the process of this invention differs markedly from the conventional physical development process in the method of forming a development nucleus for the formation of non-silver images and in the effect of image formation. While the developed silver resulting from the silver halide is directly used as a development nucleus for the formation of non-silver images in the process of this invention, no report has been made which discloses that the developed silver is intensified by an "exterior type" physical development method. In fact, a comparative study which has now been made shows that in the process of the present invention, the developed silver dispersed in gelatin has a sufficiently high activity for the development of the copper compound to non-silver images, but it does not have any developing activity for commercially available copper plating liquids. This fact shows the outstanding superiority of the process for image formation using the photographic material of this invention to the conventional copper ion physical development methods, and this, coupled with a solution of problems associated with the "exterior type" physical development methods such as the lack of stability of the developer solution and the hazardous nature of the used solution, constitutes some of the significant characteristics of the process of this invention.

A further characteristic feature of the invention is that a wide range of monovalent or divalent copper compounds (e.g. salts or complexes) can be used as image-forming substances. Moreover, while the "exterior type" physical development method generally gives brown glossy images irrespective of whether the development nucleus is a non-silver substance or silver, images obtained by the process of this invention are generally black and non-glossy, and therefore are preferred as photographic images.

On the other hand, the photographic material and process of this invention can be contrasted with the above-described photographic material and process for image formation using a photosensitive copper complex. The latter method involves exposing a photosensitive layer composed of a specified copper complex and a hydrophilic binder to ultraviolet rays, and then developing it with a physical development solution containing a copper ion or another metal ion, or dipping it in a reducing agent solution to develop it chemically, and its application to printed circuits has been suggested. The method for forming images by chemical development is of the "inner type" because the copper complex as an image-forming substance is present in the photosensitive layer. This method can be considered in some respects analogous to the process of this invention because a copper complex is used. However, in the photographic material of this invention, a vacuum-deposited or sputtered silver halide layer or a silver halide emulsion layer is further provided on the layer containing the copper salt or complex and a hydrophilic binder, and images are formed from the copper compound by the action of metallic silver resulting from this upper layer. Thus, in the prior method, images can be obtained only by exposure to ultraviolet rays, and it is difficult to perform image recording using a general optical system (e.g., with a glass lens), and the image obtained has a low photographic density. In contrast, since the silver halide layer is used as a photosensitive substance in the present invention, the photographic material has high sensitivity, and is usually sensitive not only to ultraviolet rays but also to light rays in the visible region. Furthermore, the photographic material of this invention can be easily rendered sensitive to light of the desired wavelength within the visible region using known spectral sensitizing techniques for silver halide photographic materials. In tnis way, unique and excellent results can be obtained in this invention. Thus, the photographic material of this invention has higher performance than those photographic materials using a photosensitive copper complex, and can be used for a wide range of photographic image recording.

The superiority of the present invention as described hereinabove to conventional techniques will become apparent from the working examples to be given hereinbelow.

The composition of the photographic material of this invention and the process for image formation using this photographic material are described in detail below.

The monovalent or divalent copper salt or complex used as an image-forming substance in the photographic material of the invention is at least one compound selected from the following compounds $$Cu_nX_mY_l \cdot gCu_{n'}Z_{m'} \quad (1)$$

$$[Cu_nA_mB_l]X_{l'} \quad (2)$$

$$M_rM'_s[Cu_nA_mB_lX_{m'}Y_{l'}] \quad (3)$$

wherein n is an integer of 1 to 5; n' is an integer of 0 to 5; m, m', l, g, r and s each is an integer of 0 to 7 with the proviso that m and l are not 0 at the same time; l' is an integer of 1 to 10; X and Y each is an anion with a valence of 1 to 3; A and B each represents a neutral molecule having the ability to coordinate as a Lewis base; Z is an anion with a valence of 1 to 3, a neutral molecule having the ability to coordinate as a Lewis base, or an element of group VIa; and M and M' each represents a cation with a valence of 1 to 3.

More specifically, X and Y includes anions derived from inorganic acids. Specific examples of these anions include anions with a valence of 1 to 3 which are derived from sulfuric acid, nitric acid, hydrochloric acid, hydrofluoric acid, hydriodic acid, hydrobromic acid, phosphoric acid, phosphorous acid, nitrous acid, sulfurous acid, thiosulfuric acid, carbonic acid, arsenic acid, boric acid, hydrogen cyanide, perchloric acid, perbromic acid, periodic acid, chromic acid, molybdic acid, hydrogen azide, hydrogen sulfide, selenic acid, telluric acid, tungstic acid, hypochlorous acid, hydroboric acid, and hydrogen thiocyanide. X and Y further includes anions such as a hydroxyl ion, a boron tetrahydride ion, a boron cyanohydride ion, tetraaryl boron ions (the aryl group being a phenyl group or a phenyl group substituted with an alkyl group with 1 to 5 carbon atoms (e.g., a methyl group, an ethyl group, a propyl group, an isopropyl group, a butyl group, a t-butyl group, a pentyl group, an isopentyl group, etc., uch as a tolyl group, a xylyl group, a mesityl group, tc.), and anions derived from carboxylic acids of the ormula $R^1(COOH)_p$, ulfonic acids of the formula $R^2(SO_3H)_{p'}$, }-diketones of the formula $R^3COCHR^4COR^5$, henols of the formula

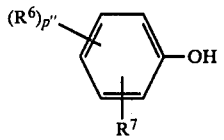

nd naphthols of the formula

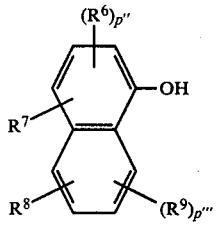

In the above formulae, $R^1$ represents a hydrogen tom or an unsubstituted or substituted, straight-chain, ranched-chain or cyclic alkyl group containing 1 to 25 arbon atoms or an unsubstituted or substituted aryl roup with 1 to 3 rings (in the following, the number of ings of the aryl group includes both the number of ings in fused polynuclear residues such as a naphtyl roup and that of rings in ring assembly residues such as biphenyl group). Suitable examples of straight chain lkyl groups for $R^1$ include a methyl group, an ethyl roup, a propyl group, a butyl group, a pentyl group, a exyl group, a heptyl group, an octyl group, a nonyl roup, a decyl group, an undecyl group, a dodecyl roup, a tetradecyl group, a pentadecyl group, a hexa-ecyl group, a heptadecyl group, an octadecyl group, n eicosyl group, a dodosyl group, a tetracosyl group, tc. Suitable examples of branched-chain alkyl groups or $R^1$ include an isopropyl group, a sec-butyl group, a ert-butyl group, a tert-pentyl group, an isohexyl group, 1-methylpentyl group, a 2-methylpentyl group, a 5-ethylhexyl group, a 6-methylheptyl group, a 1-ethyl-eptyl group, a 2-ethylheptyl group, a 3-ethylheptyl roup, a 5-ethylheptyl group, a 1-methylnonyl group, a -methylnonyl group, a 3-methylnonyl group, an 8-ethylnonyl group, a 1-methyldecyl group, a 2-thyldecyl group, a 3-ethyldecyl group, a 4-ethyldecyl roup, a 5-ethyldecyl group, a 10-methylundecyl roup, a 12-methyltridecyl group, a 13-methyltetrade-yl group, a 14-methylpentyldecyl group, a 16-methyl-entyldecyl group, a 17-methyloctadecyl group, a 21-ethyldocosyl group, a 22-methyltriscol group, etc. uitable examples of cyclic alkyl groups for $R^1$ include cyclohexyl group, a methylcyclohexyl group, a dime-ylcyclohexyl group, an ethylcyclohexyl group, a die-thylcyclohexyl group, a propylcyclohexyl group, an isopropylcyclohexyl group, a butylcyclohexyl group, a cyclopentyl group, a methylcyclopentyl group, an ethylcyclopentyl group, etc.

p is an integer of 1 to 6.

$R^2$ represents an unsubstituted or substituted straight-chain, branched-chain, or cyclic alkyl group containing 11 to 18 carbon atoms, or an unsubstituted or substituted aryl group containing 1 to 3 rings. Suitable examples of straight chain alkyl groups for $R^2$ include an undecyl group, a dodecyl group, a tridecyl group, a tetradecyl group, a pentyldecyl group, a hexadecyl group, a heptadecyl group, an octadecyl group, etc., suitable examples of branched-chain alkyl groups for $R^2$ include a 9-methyldecyl group, a 10-methylundecyl group, an 11-methyldodecyl group, a 13-methylpentadecyl group, a 15-methylhexadecyl group, a 16-methylheptadecyl group, a 1-methylundecyl group, a 2-methyltetradecyl group, a 1-ethyldecyl group, a 1-propyldecyl group, etc. and suitable examples of cyclic alkyl groups for $R^2$ include a pentylcyclohexyl group, a butylcyclohexyl group, a dipropylcyclohexyl group, a dipropylcyclopentyl group, etc.

p' is an integer of 1 to 6, $R^3$ and $R^5$ each represents an unsubstituted or substituted, straight-chain, branched chain or cyclic alkyl group containing 1 to 5 carbon atoms, an unsubstituted or substituted aryl group containing 1 to 3 rings, an unsubstituted or substituted furyl group, an unsubstituted or substituted thienyl group, an alkoxy group, or a hydrogen atom. Suitable examples of straight chain alkyl groups for $R^3$ and $R^5$ include a methyl group, an ethyl group, a propyl group, a butyl group, and a pentyl group, etc., suitable examples of branched chain alkyl groups for $R^3$ and $R^5$ include an isopropyl group, a tert-butyl group, a neopentyl group, a tert-pentyl group, etc., and suitable examples of cyclic alkyl groups for 3 and $R^5$ include a cyclopentyl group, etc. Suitable examples of alkoxy groups for $R^3$ and $R^5$ include a methoxy group, an ethoxy group, a propoxy group, an isopropoxy group, a butoxy group, an isobutoxy group, etc.

$R^4$ represents a hydrogen atom, an unsubstituted or substituted, straight-chain, branched chain or cyclic alkyl group containing 1 to 5 carbon atoms, an unsubstituted or substituted aryl group containing 1 to 3 rings, a halogen atom (e.g., a chlorine atom, a bromine atom, and an iodine atom), a nitro group, or a thiocyano group. Suitable examples of straight chain alkyl groups for $R^4$ include a methyl group, an ethyl group, a propyl group, a butyl group, a pentyl group, etc., suitable examples of branched chain alkyl groups for $R^4$ include an isopropyl group, an isobutyl group, an isopentyl group, etc., and suitable examples of cyclic alkyl groups for $R^4$ include a cyclopentyl group, etc.

$R^6$ and $R^9$ each represents a formyl group, a carboxyl group, an acetyl group, an amino group, a hydroxyamino group, an aminomethyl group, an aminoethyl group, a carbamoyl group, an N-aryl carbamoyl group with the aryl moiety containing 1 to 3 rings (e.g., N-phenyl carbamoyl, N-tolyl carbamoyl, N-naphthyl carbamoyl), an N-hydroxyiminomethine group, an N-aryl iminomethine group with the aryl moiety containing 1 to 3 rings (e.g., N-phenyl iminomethine, N-tolyl iminomethine, N-naphthyl iminomethine), a hydroxyl group, a cyano group, a pyridyl group, an alkylpyridyl group with the alkyl moiety containing 1 to 5 carbon atoms (e.g., methyl, ethyl, propyl, butyl, pentyl, isopropyl, isobutyl, isopentyl, cyclopentyl, etc.) (hereinafter the same), an aminophenyl group, a furyl group, an alkylfuryl group with the alkyl moiety containing 1 to 5 carbon atoms, a pyrrolyl group, an alkylpyrrolyl group with the alkyl moiety containing 1 to 5 carbon atoms, an imidazolyl group, an alkylimidazolyl group with the alkyl moiety containing 1 to 5 carbon atoms, a pyrazinyl group, an alkylpyrazinyl group with the alkyl moiety containing 1 to 5 carbon atoms, a pyrimidinyl group, a quinolinyl group, an isoquinolinyl group, a morpholinyl group, or a mercapto group.

$R^7$ and $R^8$ each represents an unsubstituted or substituted straight-chain, branched-chain or cyclic alkyl group containing 1 to 25 carbon atoms, an unsubstituted or substituted aryl group containing 1 to 3 rings, a nitro group, a sulfonic acid group, an alkoxycarbonyl group in which the alkoxy moiety contains 1 to 10 carbon atoms, or a hydrogen atom. Suitable examples of straight chain alkyl groups for $R^7$ and $R^8$ include a methyl group, an ethyl group, a propyl group, a butyl group, a pentyl group, a hexyl group, a heptyl group, an octyl group, a nonyl group, a decyl group, a dodecyl group, a tetradecyl group, a pentadecyl group, etc. Suitable examples of branched chain alkyl groups for $R^7$ and $R^8$ include an isopropyl group, an isobutyl group, a tert-butyl group, an isopentyl group, a tertpentyl group, a 5-methylhexyl group, a 6-methylheptyl group, a 7-methyloctyl group, a 1-methyloctyl group, an 8-methylnonyl group, a 10-methylundecyl group, a 1-methyldodecyl group, a 1-ethyldodecyl group, etc. Further, suitable examples of cyclic alkyl groups for $R^7$ and $R^8$ include a cyclopentyl group, a cyclohexyl group, a cycloheptyl group, 2-norbornyl group.

p'' and p''' each is an integer of 0 to 5.

Examples of substituents for $R^1$, $R^2$, $R^3$, and $R^5$ are alkoxy groups containing 1 to 5 carbon atoms (e.g., methoxy, ethoxy, propoxy, isopropoxy, butoxy, isobutoxy, etc.), aryloxy groups with the aryl moiety containing 1 to 3 rings (e.g., phenoxy, naphthyloxy, anthryloxy, phenanthryloxy, methylphenoxy, ethylphenoxy, methylnaphthyloxy, methylanthryloxy, etc.), a nitro group, an amino group, mono- or di-alkylamino groups with each alkyl moiety containing 1 to 5 carbon atoms (e.g., dimethylamino, methylethylamino, diethylamino, methylpropylamino, dibutylamino, dipentylamino, diisopropylamino, etc.), N-alkyl-N-arylamino groups with the alkyl moiety containing 1 to 5 carbon atoms and the aryl moiety containing 1 to 3 rings (e.g., N-methyl-N-phenylamino, N-ethyl-N-phenylamino, N-propyl-N-phenylamino, N-butyl-N-phenylamino, N-isopropyl-N-phenylamino, N-methyl-N-naphthylamino, N-methyl-N-tolylamino, N-methyl-N-xylylamino, N-methyl-N-mesitylamino, etc.), mono- or diarylamino groups with the aryl group containing 1 to 3 rings (e.g., N-phenylamino, N-tolylamino, N-naphthylamino, N-anthrylamino, N-mesitylamino, N,N-diphenylamino, N,N-ditolylamino, N,N-dinaphthylamino, etc.), aralkyl groups (with the divalent alkylene moiety containing 1 to 5 carbon atoms and the aryl moiety containing 1 to 3 rings) (e.g., benzyl, phenethyl, diphenylmethyl, trityl, phenylpropyl, phenylbutyl, phenylpentyl, naphthylmethyl, naphthylethyl, phenanthrylmethyl, anthrylmethyl, etc.) halogen atoms (e.g., chlorine, bromine, iodine, etc.), an acetyl group, acetylaryl groups with the aryl moiety containing 1 to 3 rings (e.g., acetylphenyl, acetylnaphthyl, acetyltolyl, etc.), a hydroxyl group, a trifluoromethyl group, a cyano group, a thiocyano group, a pyridyl group, alkylpyridyl groups with the alkyl moiety containing 1 to 5 carbon atoms (e.g., methyl, ethyl, propyl, butyl, pentyl, isopropyl, isobutyl, isopentyl, cyclopentyl, etc.), in which these alkyl moieties can be further substituted with a hydroxy group or an alkoxy group having 1 to 5 carbon atoms, hereinafter the same), a furyl group, alkylfuryl groups with the alkyl moiety containing 1 to 5 carbon atoms, a pyrrolyl group, alkylpyrrolyl groups with the alkyl moiety containing 1 to 5 carbon atoms, an imidazolyl group, alkylimidazolyl groups with the alkyl moiety containing 1 to 5 carbon atoms, a pyrazinyl group, alkylpyrazinyl groups with the alkyl moiety containing 1 to 5 carbon atoms, a pyrimidinyl group, a quinolinyl group, an isoquinolinyl group, a morpholinyl group, a mercapto group, a formyl group, and alkylamino groups with the alkyl moiety containing 1 to 5 carbon atoms (e.g., methyl, ethyl, propyl, butyl, pentyl, isopropyl, isobutyl, isopentyl, cyclopentyl, etc.). In $R^1$, $R^2$, $R_3$ and $R^5$, where such is a substituted aryl group, a suitable substituent is also an alkyl group containing 1 to 5 carbon atoms (e.g., methyl, ethyl, propyl, isopropyl, butyl, tert-butyl, pentyl, isopentyl, etc.). $R^4$ may have a substituent selected from the group consisting of a nitro group, a cyano group, a thiocyano group, an acetyl group and a trifluoromethyl group. $R^7$ and $R^8$ may be substituted with a halogen atom (e.g., chlorine, bromine, iodine, etc.), a hydroxyl group or an alkoxy group having 1 to 5 carbon atoms (e.g., methoxy, ethoxyl, propoxy, isopropoxy, butoxy, isobutoxy, etc.).

A and B each represents a neutral molecule which contains an atom having a lone electron pair and which acts as a "Lewis base". Specific examples of A and B include straight-chain, branched-chain or cyclic alkylamines containing 1 to 25 carbon atoms (e.g., methyl, ethyl, propyl, butyl, pentyl, hexyl, heptyl, octyl, nonyl, decyl, undecyl, dodecyl, tetrodecyl, pontadecyl, hexadecyl, heptadecyl, octadecyl, eicosyl, docosyl, tetracosyl, isopropyl, isobutyl sec-butyl, tert-butyl, isopentyl, neopentyl, tert-pentyl, isohexyl, 1-methylpentyl, 2-methylpentyl, 5-methylhexyl, 6-methylheptyl, 1-ethylheptyl, 2-ethylheptyl, 3-ethylheptyl, 5-ethylheptyl, 1-methylnonyl, 2-methylnonyl, 3-methylnonyl, 8-methylnonyl, 1-methyldecyl, 2-ethyldecyl, 3-ethyldecyl, 4-ethyldecyl, 5-ethyldecyl, 10-methylundecyl, 12-methyltridecyl, 13-methyltetradecyl, 14-methylpentadecyl, 16-methylheptadecyl, 17-methyloctadecyl, 21-methyldocosyl, 22-methyltricosyl, cyclohexyl, methylcyclohexyl, dimethylcyclohexyl, ethylcyclohexyl, diethylcyclohexyl, propylcyclohexyl, isopropylcyclohexyl, butylcyclohexyl, cyclopentyl, methylcyclopentyl, ethylcyclopentyl, etc.), and 1 to 4 amino groups, ammonium, imidazole, substituted imidazoles, pyrazole, substituted pyrazoles, pyridine, substituted pyridines, pyrazine, substituted pyrazines, pyrimidine, substituted pyrimidines, pyridazine, substituted pyridazines, indole, substituted indoles, purine, substituted purines, quinoline, substituted quinolines, isoquinoline, substituted isoquinolines, naphthyridine, substituted naphthyridines, quinoxaline, substituted quinoxalines, acridine, substituted acridines, thiophene, substituted thiophenes, benzothiophene, substituted benzothiophenes, naphthothiophene, substituted naphthothiophenes, thianthrene, and substituted thianthrenes (wherein the substituent on these rings is an alkyl group containing 1 to 5 carbon atoms, a nitro group, an alkoxy group containing 1 to 5 carbon atoms (e.g., methoxy, ethoxyl, propoxy, isopropoxy, butoxy, isobutoxy, etc.), an aryloxy group with 1 to 3 rings (e.g., phenoxy, naphthyloxy, anthryloxy, phenanthryloxy, methylphenoxy, ethylphenoxy, methylnaphthyloxy, methylanthryloxy, etc.), an amino group, a mono- or di-alkylamino group with the alkyl moiety containing 1 to 5 carbon atoms, an N-alkyl-N-arylamino group with the alkyl moiety containing 1 to 5 carbon atoms and the aryl moiety containing 1 to 3 rings (e.g., N-methyl-N-phenylamino, N-ethyl-N-phenylamino, N-propyl-N-phenylamino, N-butyl-N-phenylamino, N-isopropyl-N-phenylamino, N-methyl-N-naphthylamino, N-methyl-N-tolylamino, N-methyl-N-xylylamino, N-methyl-N-mesitylamino, etc.), a mono- or di-arylamino group with 1 to 3 rings (e.g., N-phenylamino, N-tolylamino, N-naphthylamino, N-anthrylamino, N-mesitylamino, N,N-diphenylamino, N,N-ditolylamino, N,N-dinaphthylamino, etc.), an aralkyl group with the alkyl moiety containing 1 to 5 carbon atoms and the aryl moiety containing 1 to 3 rings (e.g., benzyl, phenethyl, diphenylmethyl, trityl, phenylpropyl, phenylbutyl, phenylpentyl, naphthylmethyl, naphthylethyl, phenanthrylmethyl, anthrylmethyl etc), a halogen atom (e.g., chlorine, bromine, iodine, etc., an acetyl group, an acetylaryl group with 1 to 3 rings (e.g., acetylphenyl, acetylnaphthyl, acetyltolyl, etc.), a formyl group, a trifluoromethyl group, a cyano group, a thiocyano group, a pyridyl group, an alkylpyridyl group with the alkyl moiety containing 1 to 5 carbon atoms (e.g., methyl, ethyl, propyl, butyl, pentyl, isopropyl, isobutyl, isopentyl, cyclopentyl, etc., hereinafter the same), a furyl group, an alkylfuryl group with the alkyl moiety containing 1 to 5 carbon atoms, a pyrrolyl group, an alkylpyrrolyl group with the alkyl moiety containing 1 to 5 carbon atoms, an imidazolyl group, an alkylimidazolyl group with the alkyl moiety containing 1 to 5 carbon atoms, a pyrazinyl group, an alkylpyrazinyl group with the alkyl moiety containing 1 to 5 carbon atoms, a pyrimidinyl group, a quinolinyl group, an isoquinolinyl group, a morpholinyl group, or a mercapto group); and thioethers of the formula $$R^{10}—S—R^{11},$$

phosphine compounds of the formula

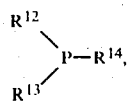

stibine compounds of the formula

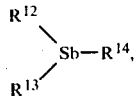

and nitriles of the formula $$NC—R^{15}—CN$$

(wherein $R^{10}$ and $R^{11}$ each represents an unsubstituted or substituted straight-chain, branched-chain or cyclic alkyl group containing 1 to 15 carbon atoms (e.g., unsubstituted straight chain alkyl groups such as methyl, ethyl, propyl, butyl, pentyl, hexyl, heptyl, octyl, nonyl, decyl, dodecyl, tetradecyl, pentadecyl, etc., unsubstituted branched chain alkyl groups such as isopropyl, isobutyl, tert-butyl, isopentyl, tert-pentyl, 5-methylhexyl, 6-methylheptyl, 7-methyloctyl, 1-methyloctyl, 8-methylnonyl, 10-methylundecyl, 1-methyldodecyl, 1-ethyldodecyl, etc., and unsubstituted cyclic alkyl groups such as cyclopenyl, cyclohexyl, cycloheptyl, 2-norbornyl), or an unsubstituted or substituted aryl group containing 1 to 3 rings (e.g., phenyl, naphthyl, anthryl, phenanthryl, etc.); $R^{12}$, $R^{13}$ and $R^{14}$ each represents a hydrogen atom, an unsubstituted or substituted straight-chain, branched-chain or cyclic alkyl group containing 1 to 15 carbon atoms (e.g., unsubstituted straight chain alkyl groups such as methyl, ethyl, propyl, butyl, pentyl, hexyl, heptyl, octyl, nonyl, decyl, dodecyl, tetradecyl, pentadecyl, etc., unsubstituted branched chain alkyl groups such as isopropyl, isobutyl, tert-butyl, isopentyl, tert-pentyl, 5-methylhexyl, 6-methylheptyl, 7-methyloctyl, 1-methyloctyl, 8-methylnonyl, 10-methylundecyl, 1-methyldodecyl, 1-ethyldodecyl, etc., and unsubstituted cyclic alkyl groups such as cyclopentyl, cyclohexyl, cycloheptyl, 2-norbornyl), an unsubstituted or substituted aryl group containing 1 to 3 rings (e.g., phenyl, naphthyl, anthryl, phenanthryl, etc.), an alkoxy group containing 1 to 15 carbon atoms (e.g., methoxy, ethoxy, propoxy, butoxy, pentyloxy, isopentyloxy, benzyloxy, hexyloxy, heptyloxy, decyloxy, tetradecyloxy, cyclohexyloxy, etc.), or an aryloxy group containing 1 to 3 rings (e.g., phenoxy, naphthyloxy, anthryloxy, phenanthryloxy, methylphenoxy, ethylphenoxy, methylnaphthyloxy, methylanthryloxy, etc.); and $R^{15}$ represents an unsubstituted or substituted, straight-chain, branched-chain or cyclic divalent alkylene residue containing 1 to 6 carbon atoms (to be referred to hereinafter simply as an alkylene group (e.g., methylene, ethylene, propylene, butylene, pentylene, hexylene, cyclopenthylene, cyclohexylene, isopropylene, isobutylene, isopenthylene, dimethylethylene, dimethylbutylene, trimethylene, tetramethylene, pentamethylene, hexamethylene, etc., a phenylene group, a substituted phenylene group or an unsubstituted or substituted dialkylene phenylene group with the alkylene moiety containing 1 to 5 carbon atoms). Where $R^{10}$ through $R^{15}$ are substituted, the substituent can be an alkoxy group containing 1 to 5 carbon atoms (e.g., methoxy, ethoxyl, propoxy, isopropoxy, butoxy, isobutoxy, etc.), an aryloxy group containing 1 to 3 rings (e.g., phenoxy, naphthyloxy, anthryloxy, phenanthryloxy, methylphenoxy, ethylphenoxy, methylnaphthyloxy, methylanthryloxy, etc.), a nitro group, an amino group, a mono- or dialkylamino group with the alkyl moiety containing 1 to 5 carbon atoms (e.g., methylamino, dimethylamino, ethylamino, methylethylamino, diethylamino, propylamino, methylpropylamino, butylamino, dibutylamino, pentylamino, isopropylamino, etc.), an N-alkyl-N-arylamino group with the alkyl moiety containing 1 to 5 carbon atoms and the aryl group containing 1 to 3 rings (e.g., N-methyl-N-phenylamino, N-ethyl-N-phenylamino, N-propyl-N-phenylamino, N-butyl-N-phenylamino, N-isopropyl-N-phenylamino, N-methyl-N-naphthylamino, N-methyl-N-tolylamino, N-methyl-N-xylylamino, N-methyl-N-mesitylamino, etc.), a mono- or diarylamino group with the aryl moiety containing 1 to 3 rings and being optionally substituted with an alkyl group containing 1 to 5 carbon atoms (e.g., N-phenylamino, N-tolylamino, N-naphthylamino, N-anthrylamino, N-mesitylamino, N,N-diphenylamino, N,N-ditolylamino, N,N-dinaphthylamino, etc.), an aralkyl group with the divalent alkylene residue containing 1 to 5 carbon atoms and the aryl moiety containing 1 to 3 rings (e.g., benzyl, phenethyl, diphenylmethyl, trityl, phenylpropyl, phenylbutyl, phenylpentyl, naphthylmethyl, naphthylethyl, phenanthrylmethyl, anthrylmethyl etc.) a halogen atom (e.g., chlorine, bromine, iodine, etc.), an acetyl group, an acetylaryl group with the aryl moiety containing 1 to 3 rings (e.g., actylphenyl, acetylnaphthyl, acetyltolyl, etc.), a hydroxyl group, a trifluoromethyl group, a cyano group, a thiocyano group, or a formyl group. Where $R^{10}$ through $R^{15}$ is a substituted aryl group a suitable substituent is also an alkyl group containing 1 to 5 carbon atoms (e.g., methyl, ethyl, propyl, isopropyl, butyl, tertbutyl, pentyl, isopentyl, etc.).

Z represents one member selected from the group consisting of the members given hereinabove for X, Y, A and B, oxygen, sulfur, selenium, tellurium, and water.

M and M' each represents an inorganic or organic cation having a valence of 1 to 3. Specifically, M and M' each represents a member selected from the group consisting of an ammonium ion, and lithium, sodium, potassium, rubidium, magnesium ($Mg^{2\oplus}$), calcium, strontium, barium, aluminum, thallium ($Tl^{3\oplus}$), chromium ($Cr^{3\oplus}$), iron ($Fe^{2\oplus}$ and $Fe^{3\oplus}$), cobalt ($Co^{2\oplus}$ and $Co^{3\oplus}$), nickel ($Ni^{2\oplus}$ and $Ni^{3\oplus}$), palladium ($Pd^{2\oplus}$), platinum ($Pt^{2\oplus}$), silver, gold ($Au^{\oplus}$ and $Au^{3\oplus}$), zinc, cadmium, and mercury ($Hg^{2\oplus}$) cations, and diazonium ions of the formula $ArN_2^{\oplus}$ wherein Ar represents a phenyl group, or a substituted phenyl group in which the substituent is a straight-chain, branched-chain or cyclic alkyl group containing 1 to 6 carbon atoms (e.g., methyl, ethyl, propyl, butyl, pentyl, isopropyl, isobutyl, isopentyl, cyclopentyl, etc.), a nitro group, an alkoxy group containing 1 to 5 carbon atoms (e.g., methoxy, ethoxyl, propoxy, isopropoxy, butoxy, isobutoxy, etc.), an aryloxy group with the aryl moiety containing 1 to 2 rings (e.g., phenyl, naphthyloxy, etc.), an amino group, a mono- or di-alkylamino group with the alkyl moiety containing 1 to 5 carbon atoms (e.g., methylamino, dimethylamino, ethylamino, methylethylamino, diethylamino, propylamino, methylpropylamino, butylamino, dibutylamino, pentylamino, isopropylamino, etc.), an N-alkyl-N-arylamino group with the alkyl moiety containing 1 to 5 carbon atoms and the aryl moiety containing 1 to 3 rings (e.g., N-methyl-N-phenylamino, N-ethyl-N-phenylamino, N-propyl-N-phenylamino, N-butyl-N-phenylamino, N-isopropyl-N-phenylamino, N-methyl-N-naphthylamino, N-methyl-N-tolylamino, N-methyl-N-xylylamino, N-methyl-N-mesitylamino, etc.), a mono- or diarylamino group with the aryl moiety containing 1 or 2 rings and being optionally substituted with an alkyl group containing 1 to 5 carbon atoms (e.g., N-phenylamino, N-tolylamino, N-naphthylamino, N-anthrylamino, N-mesitylamino, N,N-diphenylamino, N,N-ditolylamino, N,N-dinaphthylamino, etc.), an aralkyl group with the divalent alkylene residue containing 1 to 5 carbon atoms and the aryl moiety containing 1 or 2 rings (e.g., benzyl, phenethyl, diphenylmethyl, trityl, phenylpropyl, phenylbutyl, phenylpentyl, naphthylmethyl, naphthylethyl, phenanthrylmethyl, anthrylmethyl etc.), a halogen atom (e.g., chlorine, bromine, iodine, etc.), an acetyl group, an acetylaryl group with 1 to 2 rings (e.g., acetylphenyl, acetylnaphthyl, acetyltolyl, acetylanthryl, etc.), a formyl group, a trifluoromethyl group, a cyano group, a thiocyano group, or a hydroxyl group.

Specific examples of the monovalent or divalent copper compounds (e.g., salts or complexes) that can be used as image-forming substances in the present invention are given below in terms of their chemical formulae.

$CuCl$, $CuCl_2$, $CuOH$, $Cu(OH)_2$, $CuBr$, $CuBr_2$, $CuCl_2.Cu(OH)_2$, $Cu(ClO)_2$, $Cu(BrO_3)_2$, $Cu(ClO_4)_2$, $Cu(ClO_2)_2.3Cu(OH)_2$, $CuCN$, $CuSCN$, $CuCO_3$, $CuCO_3.Cu(OH)_2$, $CuI$, $CuNO_3$, $Cu(NO_3)_2.Cu(N_3)_2$, $Cu(NO_2)_3.3Cu(OH)_2$, $Cu_3(PO_4)_2$, $Cu_2S$, $CuSO_3$, $CuSO_4$, $CuS_4O_6$, $CuSO_4.3Cu(OH)_2$, $Cu_2Se$, $CuTeO_4$, $Cu_2WO_4.2CuWO_4$, $K_2[CuCl_2(H_2O)_2]Cl_2$, $K_2Cu(SO_4)_2$, $KCa[Cu(NO_2)_6]$, $K[Cu(S_2O_3)]$, $Na_3[Cu(S_2O_3)_2]$, $(NH_4)_2Cu(SO_4)_2$, $Cu(HCOO)_2$, $Cu(CH_3COO)_2$, $Cu(CH_3COO)$, $Cu(CH_3COO)_2.3CH_3COOK$, $Cu(CH_3COO)_2.3Cu(AsO_2)_2$, $(NH_4)_2[Cu(CH_3COO)_4]$, $Cu(BrCH_2COO)_2$, $Cu(C_6H_5COO)_2$, $Cu(C_6H_5COO)$, $Cu(C_{15}H_{31}COO)_2$, $Cu(C_{17}H_{35}COO)_2$, $Cu(C_{12}H_{65}COO)_2$, $Cu(C_{10}H_{21}COO)_2$, $Cu(C_3H_7COO)_2$, $Cu(C_6H_5C_{10}H_{20}COO)_2$, $Cu(HOC_6H_4COO)_2$, $Cu[C_6H_3(OH)_2COO]_2$, $Cu(C_2H_5C_6H_4COO)_2$, $Cu(OC_6H_4CHO)_2$, $Cu[CH_3CH(OH)COO]_2$, $Cu[CH_3CH(NH_2)COO]_2$, $Cu[HOCH_2CH(OH)COO]_2$, $Cu[OOCCH_2CH(NH_2)COO]$, $Cu[OOC(CHOH)_2COO]$, $Cu_2[OOC(CHOH)_2COO]$, $Cu[ONC(CH_3)C(CH_3)NOH]_2$, $Cu(CH_3COCHCHCHO)_2$, $Cu[OOCCH(NH_2)CH_2CH_2COO]$, $Cu(CH_3COCHCOCH_3)_2$, $Cu(CH_3COCHCOOCH_3)_2$, $Cu(CF_3COCH_2COCH_3)_2$, $Cu(C_6H_5COCHCOCH_3)_2$,

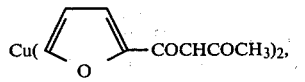

$Cu(C_6H_5COCHCOCF_3)_2$, $Cu(CH_3COC(C_6H_5)COCH_3)_2$, $Cu(CH_3COCBrCOCH_3)_2$, $Cu(CH_3COCCH_3COCH_3)_2$, $Cu(CH_3COCHCOOC_2H_5)_2$, $Cu[(CH_3CO)_2CCOOCH_3]_2$, $Cu[(CH_3COCHCOOC_2H_5)_2(NH_3)_2]$, $Cu(C_5H_4NCOO)_2$, $Cu[C_5H_3N(COO)_2]$, $Cu(NH_2C_6H_4SO_3)_2$, $Cu(HOC_6H_5SO_3)_2$, $Cu[(CH_3)_2CHCH_2CH(NH_2)COO]_2$, $Cu(C_6H_5CONH_2COO)_2$, $Cu[OOC(CH_2)_8COO]$, $Cu(OC_6H_4CH{=}NH)_2$, $Cu[OC_6H_3(NO_2)CH_2NH_2]_2$, $Cu[(CH_3)_2NCS_2]_2$, $Cu(NH_3)_2Cl_2$, $[Cu(NH_3)_2](NCS)_2$, $[Cu(C_5H_5N)_6]Cl_2$, $[Cu(C_5H_5N)_6](ClO_4)_2$, $[Cu(C_5H_5N)_6](NO_3)_2$, $\{Cu[(C_5H_4N)_2]_3\}Cl_2$, $\{Cu[(C_5H_4N)_2]_2\}(NO_3)_2$, $[Cu(H_2NCH_2CH_2NH_2)_2]Cl_2$, $[Cu(H_2NCH_2CH_2NH_2)_3]Cl_2$, $[Cu(H_2NCH_2CH_2NH_2)_2](ClO_4)_2$, $\{Cu[H_2N(CH_2)_4NH_2]\}_2(ClO_4)_2$, $[Cu(H_2NCH_2CH_2NH_2)_2].[B(C_6H_5)_4]_2$, $Cu[(H_2NCH_2COO)_2(H_2NCH_2CH_2NH_2)_2]$, $[Cu(CH_3CSNH_2)_4]Cl$, $[Cu(CH_3CSNH_2)_4]NO_3$, $[Cu(CH_3CSNH_2)_4]_2SO_4$, $[Cu(CH_3CSNH_2)_4]Br$, $[Cu(CH_3SCH_2CH_2SCH_3)]Br$, $Cu(CH_3SCH_2CH_2SCH_3)Cl_2$,

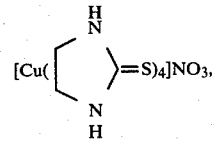

$Cu(C_6H_5CH_2SCH_2C_6H_5)_2Cl_2$, $\{Cu[HONC(CH_3)C(CH_3)NOH]_2\}Cl_2$, $\{Cu[HONC(CH_3)C(CH_3)NOH]_2\}SO_4$, $[2CuCl.CH_3N{=}NCH_3].CuC_2O_4$, $\{Cu[(C_2H_5O)_3P]_3\}NO_3$, $\{Cu[(C_6H_5O)_3P]_3\}Cl$, $\{Cu[(C_6H_5O)_3P]_2\}BH_4$, $\{Cu[(C_2H_5O)_3P]_2\}BH_4$, $\{Cu[(C_2H_5O)_2P]_2\}BH_3CN$, $\{Cu[(C_6H_5)_3P]_2\}BH_4$, $\{Cu[(C_6H_5)_3P]_2\}BH_3CN$, $Cu[(CH_3C_6H_4)_3P]_3\}BH_3CN$, $\{Cu[(C_6H_5)_3Sb]_3\}NO_3$, $Cu[(C_6H_5)_3Sb]_3\}BH_3CN$, $Cu(NCCH_2CN)_2NO_3$, $Cu[NC(CH_2)_2CN]_2NO_3$, $Cu[NC(CH_2)_3CN]_2NO_3$, $Cu[NC(CH_2)_4CN]NO_3$, $Cu[NC(CH_2)_5CN]_2NO_3$, $Cu[C_6H_4(CN)_2]_2NO_3$,

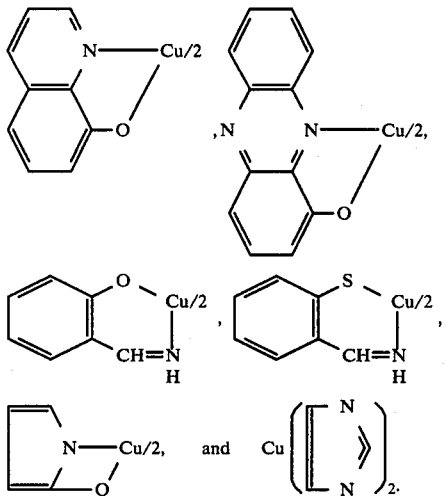

$Cu[CH_3(CH_2)_tCOO]_2$ wherein t is an integer of 1 to 16, $Cu_3(C_6H_5O_7)_2$ (copper citrate), $Cu(CH_3C_6H_4COO)_2$, $Cu(CH_3COCH_3COCH_3)_2$, $Cu(CF_3CO\text{-}CHCOCH_3)_2$, $Cu[OOC(CH_2)_uCOO]$ wherein u is an integer of 1 to 8, $Cu(H_2NCH_2CH_2NH_2)_2]$ $Br_2$, $Cu(H_2NCH_2CH_2NH_2)_2](NO_3)_2$, $Cu(H_2NCH_2CH_2NH_2)_2]SO_4$, $[Cu(C_5H_5N)_2]Cl_2$. $Cu(C_5H_5N)_2]Br_2$, $Cu[NC(CH_2)_vCN]_2NO_3$ wherein v is an integer of 1 to 8, $Cu[P(C_6H_5)_3]_2NH_4$, $Cu[P(C_6H_4CH_3)_3]_2BH_4$, $Cu[P(C_6H_5)_3]BH_3CN$, $Cu[P(C_6H_5)_3]_2NO_3$, $Cu[P(C_6H_5)_3]_4B(C_6H_5)_4$, $Cu[P(C_6H_5)_3]_2Cl$, $Cu[Sb(C_6H_5)_3]_3Cl$, $Cu[P(OCH_3)_3]_4B(C_6H_5)_4$ and $Cu[P(OCH_3)_3]_3BH_3CN$.

Of the above copper compounds, those having a standard oxidation-reduction potential of at least −0.54 V provide preferred images. In view of the stability and the speed of the progress of development, compounds having a standard oxidation-reduction potential of from 0 V to 0.55 V are more preferably used so as to maintain their balance with the chemical developer solution used in this invention.

These copper compounds can be synthesized by conventional procedures described, for example, in *Inorganic Syntheses,* Vol. 5, McGraw-Hill Book Company, Inc. (1957) Ibid, Vol. 7 (1963), and Ibid, Vol. 12 (1968). In addition, reference can be made to U.S. Pat Nos. 3,859,092, 3,860,500, 3,860,501, and 3,880,724, and the references cited in these patents for the synthesis of copper complexes. The nomenclature of the above compounds is in accordance with Rules for I.U.P.A.C. Notation for Organic Compounds, A, B (1969).

A suitable amount of the copper compound in the image-forming layer is about 1 to about 50 parts by weight (as copper), preferably 1 to B 30 parts by weight, per 100 parts by weight of the binder.

The hydrophilic binder used for preparing the image-forming layer containing the copper compound in the photographic material of this invention can be a natural, semi-synthetic or synthetic polymeric substance which is water-soluble, or swellable with water or an alkaline aqueous solution. Examples of suitable binders are gelatin, albumin, casein, cellulose derivatives such as carboxymethyl cellulose, hydroxyethyl cellulose, cellulose acetate with a degree of acetylation of 40 to 60%, agar, sodium alginate, carbohydrate derivatives such as starch derivatives, and synthetic polymers such as polyvinyl alcohol, polyvinyl pyrrolidone, polyacrylic acid copolymers, polyacrylamide and the derivatives and partially hydrolyzed products of these polymers. These polymeric substances have a molecular weight of about 5,000 to about 300,000, preferably 10,000 to 100,000. They can be used either individually, or as an admixture of two or more thereof so long as they are compatible with each other. Furthermore, in order to increase water resistance or alkali resistance, these binder substances may be used after they have been cross-linked to a suitable degree.

Various sheet-like, film-like and plate-like materials to which the binder layer has good adhesion can be used as supports. Specifically, examples of support materials include natural, semi-synthetic or synthetic materials, for example, synthetic plastic films such as polyethylene terephthalate, polyimide, nylon, or triacetyl cellulose, papers (such as bartya paper, coated paper, or resin-treated paper), synthetic paper-like support materials, fabrics, leathers, artificial leathers, wooden plates, metal plates, and glass plates. The thickness of the support is usually about 10 μm to about 2 L mm, preferably 15 μm. An anti-halation layer can be provided on the support, if desired.

The photographic material of this invention is prepared by dissolving or dispersing the copper compound and the hydrophilic binder in a solvent capable of dissolving at least the binder, coating the solution or dispersion formed on the support, drying the coated layer, and then vacuum-depositing or sputtering silver halide onto top of the coating containing the copper compound, or coating a silver halide emulsion onto the coating containing the copper compound and then drying it. When a silver halide layer is formed by vacuum-deposition or sputtering, a protective layer can further be formed thereon, as required.

Suitable solvents which can be used to prepare a coating solution containing the copper compound and the hydrophilic binder include water, or an organic solvent having a high polarity. Examples of appropriate organic solvents include N,N-dimethylformamide, dimethyl sulfoxide, aliphatic ketones such as acetone or methyl ethyl ketone, lower monohydric alcohols such as methanol, ethanol or isopropanol, cyclic ethers such as tetrahydrofuran or 1,4-dioxane, esters such as ethyl acetate, ethers such as ethylene glycol monomethyl ether, and halogenated hydrocarbons such as chloroform, methylene chloride, 1,2-dichloroethane, carbon tetrachloride or trichloroethylene. These solvents can be used either individually or as an admixture of two or more. The copper compound can be dispersed in such a solvent, but preferably is dissolved and finely dispersed in the binder. It is desirable therefore to choose solvents which can achieve this. The choice of the solvent depends upon the copper compound used, and the solubilities of the copper compound in intended solvent may be tested prior to use in order to make a proper choice.

The amount of the binder will vary according, for example, to its molecular weight, but generally ranges from about 1 to about 100 parts, preferably 3 to 70 parts, by weight per 100 parts by weight of the solvent.

The layer containing the copper compound and the hydrophilic binder can, if desired, further contain a reducing agent. In particular, the reducing agent sometimes acts to promote the formation of non-silver images from the copper compound, and the same reducing agents as used for the developer solution to be described hereinafter can be used for this purpose. A suitable amount of reducing agent can range up to 2 mol/mol of the copper compound.

The coating of the solution or dispersion containing the copper compound and hydrophilic binder on the support can be performed by methods known to those skilled in the art, for example, by dip coating, air knife coating, curtain coating, rod coating, spinner coating, whirler coating, or extrusion coating using a hopper as disclosed in U.S. Pat. No. 2,681,294. The amount of the solution or dispersion coated is adjusted so that the thickness of the layer formed on the support after drying is about 1 μm to about 100 μm, preferably 3 μm to 50 μm. The drying conditions differ greatly according to the solvent used. Generally, however, the drying is carried out at about 20° to about 80° C., preferably 40° to 60° C., for about 5 to about 120 minutes, preferably 10 to 60 minutes, preferably while passing air over the layer.

Examples of silver halides which can be vacuum-deposited or sputtered on the resulting copper compound containing layer in the first embodiment of this invention are silver chloride, silver bromide, silver chlorobromide, silver iodobromide, silver chloroiodide, and silver chlorobromoiodide. These silver halides can be used either individually, or two or more of them can be deposited successively.

An ordinary vacuum-depositing device or an ordinary sputtering device can be used for the vacuum-deposition or sputtering of the silver halide. The degree of vacuum at the time of vacuum deposition or sputtering is about $10^{-3}$ torr or less, and the distance between the silver halide to be vacuum-deposited or sputtered and the substrate is desirably adjusted to at least about 10 cm. The amount of the silver halide vacuum-deposited or sputtered is adjusted so that the average thickness of the deposited coating, as monitored by a film thickness gauge (for example, DTM-20 type made by Sloan Company) is about 1 nm to about 100 nm, preferably 3 nm to 50 nm. This amount corresponds to a silver amount of about 0.004 to about 0.4 g/m$^2$, preferably 0.01 to 0.2 g/m$^2$, and thus, the amount of silver required is drastically reduced from that required in conventional silver halide emulsions.

The material obtained by providing the layer of the copper compound and the hydrophilic binder on the support, and vacuum-depositing or sputtering silver halide on top of it can be directly used as the photographic material of this invention. In order to render this material more sensitive or change the wavelength region to which the material is sensitive, the material can further be subjected to chemical sensitization or spectral sensitization treatments known to those skilled in the art of silver halide photography. For example, sodium thiosulfate, N,N,N'-trimethyl thiourea, a thiocyanate complex salt of monovalent gold, thiosulfuric acid complex salts, stannous chloride, and hexamethylene tetramine can be used as chemical sensitizers. A general method for sensitization is described in Mees and James, *The Theory of Photographic Process,* supra. Spectral sensitization or supersensitization can be carried out using cyanine dyes such as cyanine, merocyanine or carbocyanine dyes either individually or in combination with each other or with styryl dyes. These spectral sensitizing techniques are well known, and are described, for example, in U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588 and 1,293,862, German Patent Application (OLS) No. 2,030,326 and 2,121,780, Japanese Patent Publication Nos. 4936/68, 14030/69, and 10773/68, U.S. Pat. Nos. 3,511,664, 3,522,052, 3,527,641, 3,615,613, 3,615,632, 3,617,295, 3,635,721, and 3,694,217, and British Pat. Nos. 1,137,580 and 1,216,203. The method to be employed can be selected depending on the wavelength region to which the material is to be sensitized, the sensitivity desired, and the purpose and use of the photographic material.

In particular, techniques for sensitizing silver halide vacuum-deposited photographic materials which can be referred to for the present invention are described, for example, in U.S. Pat. Nos. 3,279,920, 3,219,451, 3,219,450, and 3,297,444, French Pat. Nos. 1,479,941, 1,461,967, 1,369,190 and 2,993,517, Belgian Pat. No. 641,008, and Japanese Patent Publication No. 14,111/65.

The silver halide layer vacuum-deposited or sputtered generally has a low mechanical strength, and it tends to be damaged during storage or development. In order to prevent such, a protective layer can be provided on this layer, if required. The protective layer can be formed from a water-soluble or a water- or alkaline solution penetrable substance, and the compounds exemplified hereinabove as hydrophilic binders can be suitably used. The coating of the protective layer can be carried out similarly using the same solvents as described hereinabove. A suitable thickness for the protective layer after drying is about 0.1 to about 50 μm, preferably 1 to 20 μm.

All silver halide emulsions for black and white photography which are known to those skilled in the art can be used for the preparation of the silver halide emulsion layer used in the second embodiment of the photographic material of this invention either directly, or after being diluted with an aqueous solution of a binder such as gelatin. The silver halide used in this embodiment of the photographic material of this invention need not be such that metallic silver itself formed from it provides the visible images of sufficient optical density. Rather, the silver halide merely acts as a catalyst in a reaction of forming a non-silver image (metallic copper or copper oxide) from the copper compound. Accordingly, the amount of silver used is far smaller that that used in conventional silver halide photographic materials, and the present invention provides photographic materials which use a reduced amount of silver. The amount of the silver halide used is about 0.5 to about 0.005 g/m$^2$, preferably 0.2 to 0.02 g/m$^2$, calculated as metallic silver. The lower limit of the amount of silver is determined from the catalytic amount required for the formation of copper images, but the upper limit is determined primarily from the standpoint of silver economics. Hence, there is no detrimental effect even if the amount exceeds this upper limit. The content of silver halide in the silver halide emulsion and the amount of it to be coated are adjusted so as to provide a silver amount within the above-specified range.

The silver halide emulsion can be prepared conventionally by mixing a solution of a water-soluble silver salt (for example, silver nitrate) and a solution of a water-soluble halogen salt (for example, potassium bromide) in the presence of a solution of a water-soluble polymer (binder) such as gelatin. In addition to silver chloride and silver bromide, mixed silver halides such as silver chlorobromide, silver iodobromide, or silver chloroiodide can be used as the silver halide. Desirably, the silver chlorobromide contains about 2 to about 98 mole % of silver chloride, and the silver iodobromide and silver chloroiodide contain about 1 to about 10 mole % of silver iodide. The silver halide grains can have a cubic form, an octahedral form, or be mixtures thereof. The grain size can be vary over a wide range according, for example, to the desired photosensitivity and the resolving power of the photographic material, but usually the grain size ranges from about 0.1 μm to about 5 μm.

The silver halide grains can be prepared using known conventional methods. A single or double jet method, and a control double jet method are also useful for preparing the silver halide grain. Alternatively, two or more silver halide photographic emulsions can be separately prepared and mixed to form an emulsion for use in this invention. The crystal structure of the silver halide grains can be uniform from the surface to the interior, or the structure can be a layer-like structure in which the crystal structure differs between the interior and the exterior. Alternatively, the crystal structure can be of a "conversion type" as described in British Pat. No. 635,841 and U.S. Pat. No. 3,622,318. These photographic emulsions are described, for example, in Mees et al., *The Theory of Photographic Process,* supra, and P. Glafkides, *Chimie Photographique,* Paul Montel Co., Paris (1954), and can be prepared using various known methods such as an ammonia method, a neutral method or an acidic method.

The silver halide grains so formed are washed in order to remove the by-product water-soluble salts (e.g., potassium nitrate when silver bromide is prepared from silver nitrate and potassium bromide), and then heat-treated in the presence of a chemical sensitizer to increase their sensitivity without increasing the size of the grains. General methods for achieving this are described in the references cited hereinabove.

Examples of chemical sensitizers that can be used for this purpose include gold compounds such as chloroaurates or gold trichloride described in U.S. Pat. Nos. 2,399,083, 2,540,085, 2,597,856, and 2,957,915, salts of noble metals such as those of platinum, palladium, iridium, rhodium and ruthenium described in U.S. Pat. Nos. 2,448,060, 2,540,086, 2,566,245, 2,566,263, and 2,598,079, sulfur compounds capable of forming silver sulfide by reaction with silver salts described in U.S. Pat. Nos. 1,574,944, 2,410,689, 3,189,458 and 3,501,313, stannous salts described in U.S. Pat. Nos. 2,487,850, 2,518,698, 2,521,925, 2,521,926, 2,694,637, 2,983,610, and 3,201,254, and amines such as hexamethylene tetramine.

Examples of hydrophilic colloids which can be used as binders for silver halide are gelatin, colloidal albumin, casein, cellulose derivatives such as carboxymethyl cellulose or hydroxyethyl cellulose, agar, sodium alginate, carbohydrate derivatives such as starch derivatives, and synthetic hydrophilic colloids such as polyvinyl alcohol, poly-N-vinyl pyrrolidone, polyacrylic acid copolymers, polyacrylamide, or the derivatives or partially hydrolyzed products of these synthetic colloids. If desired, two or more compatible colloids can be used as a mixture. Gelatin is most generally used. A part or all of the gelatin can be replaced by a synthetic polymeric substance. Gelatin derivatives obtained by treating the functional groups in the gelatin molecule, such as amino, imino, hydroxyl or carboxyl groups, with agents containing a group capable of reacting with such functional groups, or graft copolymers resulting from the bonding of the molecular chain of another polymeric substance to gelatin can also be used.

Examples of agents for preparing the above gelatin derivatives are the isocyanates, acid chlorides and acid anhydrides disclosed in U.S. Pat. No. 2,614,928, the acid anhydrides disclosed in U.S. Pat. No. 3,118,766, the bromoacetic acids disclosed in Japanese Patent Publication No. 5,514/64, the phenyl glycidyl ethers disclosed in Japanese Patent Publication No. 26845/67, the vinyl sulfone compounds disclosed in U.S. Pat. No. 3,132,945, the N-allyl vinyl sulfonamides disclosed in British Pat. No. 861,414, the maleinimide compounds disclosed in U.S. Pat. No. B 3,186,846, the acrylonitriles disclosed in U.S. Pat. No. 2,594,293, the polyalkylene oxides disclosed in U.S. Pat. No. 3,312,553, the epoxy compounds disclosed in Japanese Patent Publication No. 26845/67, the acid esters disclosed in U.S. Pat. No. 2,763,639, and the alkanesultones disclosed in British Pat. No. 1,033,189.

Examples of branch polymers which can be grafted to gelatin are described extensively, for example, in U.S. Pat. Nos. 2,763,625, 2,831,767 and 2,956,884, *Polymer Letters,* Vol. 5, page 595 (1967), *Phot. Sci. Eng.,* Vol. 9, 148 (1965), and J. Polymer Sci., A-1, Vol. 9, page 3199 (1971). A wide range of polymers or copolymers of acrylic acid, methacrylic acid, or the derivatives thereof such as esters, amides or nitriles, and compounds generally called vinyl monomers, such as styrene, can be used. Especially preferred examples are hydrophilic vinyl polymers having a certain degree of compatibility with gelatin, such as polymers or copolymers of acrylic acid, acrylamide, methacrylamide, hydroxyalkyl acrylates, or hydroxyalkyl methacrylates.

The emulsion can be subjected to a hardening treatment in a conventional manner, if desired. Examples of suitable hardening agents for use in this treatment are aldehyde compounds such as formaldehyde or glutaraldehyde, ketone compounds such as diacetyl or cyclopentanedione, compounds containing a reactive halogen such as bis(2-chloroethylurea), 2-hydroxy-4,6-dichloro-1,3,5-triazine, and those described, for example, in U.S. Pat. Nos. 3,288,775, 2,732,303, 3,125,449, and 1,167,207, compounds containing a reactive olefin such as divinylsulfone, 5-acetyl-1,3-diacryloylhexahydro-1,3,5-triazine and those disclosed, for example, in U.S. Pat. Nos. 3,635,718 and 3,232,763, and British Pat. No. 994,869, N-methylol compounds such as N-hydroymethyl phthalimide and those disclosed, for example, in U.S. Pat. Nos. 2,732,316 and 2,586,168, the isocyanates disclosed in U.S. Pat. No. 3,103,437, the aziridine compounds disclosed, for example, in U.S. Pat. Nos. 3,017,280 and 2,983,611, the acid derivatives disclosed, for example, in U.S. Pat. Nos. 2,725,294 and 2,725,295, the carbodimide compounds disclosed, for example, in U.S. Pat. No. 3,100,704, the epoxy compounds disclosed, for example, in U.S. Pat. No. 3,091,537, the isooxazole compounds disclosed, for example, in U.S. Pat. Nos. 3,321,313 and 3,543,292, halocarboxyaldehydes such as mucochloric acid, dioxane derivatives such as dihydroxydioxane or dichlorodioxane, and inorganic hardening agents such as chromium alum or zirconium sulfate. Instead of these compounds, precursors of hardening agents such as hydrogen sulfite, alkali metal salts, aldehyde adducts, methylol derivatives of hydantoin, and primary aliphatic nitroalcohols can also be used.

In order to prevent fog or a sensitivity reduction during the manufacture, storage or treatment of the photographic material, various compounds can be added to the silver halide emulsion as stabilizers or anit-foggants. A large number of compounds such as heterocyclic compounds (e.g., 4-hydroxy-6-methyl-1,3,3*a*,7-tetrazaindene, 3-methylbenzothiazole or 1-phenyl-5-mercaptotetrazole), mercury-containing compounds, mercapto compounds, and metal salts are well known as such compounds.

Examples of the compounds that can be used for this purpose are described in C.E.K. Mees and T. H. James, *The Theory of the Photographic Process,* 3rd Edition, pages 344 to 349, (1966) U.S. Pat. No. 1,758,576 (mercaptothiazoles), U.S. Pat. No. 2,110,178 (glutathione), U.S. Pat. No. 2,131,038 (benzothiazolium salts), U.S. Pat. No. 2,694,716 (benzothiazolium salts), U.S. Pat. No. 3,326,681 (benzoselenazolium salts), U.S. Pat. No. 2,173,628 (aminohydroxypyrimidines), U.S. Pat. No. 2,304,962 (mercaptopyrimidines), U.S. Pat. No. 2,697,040 (mercaptotetrazoles and 1-phenyl-5-tetrazoline-5-thiones), U.S. Pat. No. 2,324,123 (aminonitrobenzimidazoles, nitroindazoles, and aminoindazoles), U.S. Pat. No. 2,394,198 (e.g., salts of benzenesulfinic acids), U.S. Pat. Nos. 2,444,605 to 2,444,608 (hydroxytetrazaindenes, aminotetrazaindenes, and pentazaindenes), British Pat. No. 893,428 (mercaptotetrazaindenes), U.S. Pat. No. 2,566,245 (complexes and salts of noble metals such as platinum or iridium), U.S. Pat. No. 2,697,099 (mercaptothiazoles and benzothiazoline-2-ones), U.S. Pat. No. 2,708,162 (urazoles, parabanic acid and hydantoins), U.S. Pat. Nos. 2,728,663 to 2,728,665 (molecular adducts between mercuric halides and nitrogen-containing heterocyclic compounds), U.S. Pat. No. 2,476,536 (mercaptotriazines), U.S. Pat. No. 2,824,001 (mercaptothiazoles), U.S. Pat. No. 2,843,491 (mercaptothiazoles), U.S. Pat. No. 2,843,491 (mercaptooxadiazoles), U.S. Pat. No. 3,052,544 (poly-N-vinyl-2-pyrrolidones), U.S. Pat. No. 3,137,577 (organomercury compounds such as 8-(3-hydroxymercuri-2-methoxypropyl)-2-oxo-2H-1-benzopyran-3-carboxylic acid), U.S. Pat. No. 3,220,839 (isothiourea derivatives, and isothiouronium salt derivatives), U.S. Pat. No. 3,226,231 (mercaptobenzoic acids), U.S. Pat. No. 3,236,652 (sulfocatechols and dihydroxynaphthalenesulfonic acids), U.S. Pat. No. 3,251,691 (mercaptoimidazoles, benzoimidazoles, and nitrobenzoimidazoles), U.S. Pat. No. 3,252,799 (2-mercaptoimidazoles), British Pat. No. 403,789 (mercaptoimidazoles), U.S. Pat. No. 3,287,135 (urazoles), U.S. Pat. No. 3,420,668 [sulfonamides containing an N-Hg bond, for example, (N-phenyl-N-p-toluenesulfonamide)ethyl mercury], U.S. Pat. No. 3,622,339 (s-triazine-type polycondensates), U.S. Pat. No. 2,933,388 (4-mercapto-1,3,3*a*,7-tetrazaindenes), U.S. Pat. No. 3,567,454 (mercury (II) salts of sulfo- or sulfonato-substituted organic thiols), and U.S. Pat. No. 3,595,662 (chelate compounds formed between polyaminopolycarboxylic acids and mercury (II)).

The silver halide emulsion can be spectrally sensitized using known sensitizing dyes. Examples of sensitizing dyes and their choice are the same as described hereinabove with regard to the sensitization of silver halide that has beeen vacuum-deposited or sputtered.

A surface active agent can be added to the silver halide emulsion. It can be used as a coating aid, but can also be used for other purposes, for example, for emulsification and dispersion, sensitization, improvement of photographic characteristics, prevention of the generation of static charges, or prevention of adhesion. Examples of surfactants which can be used natural surfactants such as saponin, nonionic surfactants such as alkylene oxide-type, glycerin-type, or glycidol-type compounds, cationic surfactants such as higher alkylamines, quaternary ammonium salts, pyridine and other heterocyclic compounds, phosphoniums, or sulfoniums, anionic surfactants (containing acidic groups such as carboxylic acid, sulfonic acid, phosphoric acid, sulfate ester, or phosphate ester groups, and amphoteric surfactants such as amino acids, aminosulfonic acids, or sulfuric acid or phosphoric acid esters of aminoalcohols. Useful surfactants are also described, for example, in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, 3,666,478, and 3,507,660, and British Pat. No. 1,198,450.

The ratio between the amounts of the binder and silver halide is determined so that the amount of silver described hereinabove is obtained. The ratios of the amounts of the stabilizer, antifoggant, sensitizing dye, or surface active agent to that of the silver halide or binder can be determined in the same way as in the preparation of conventional silver halide emulsions. Such ratios can be determined on the basis of the descriptions in the above-cited publications and patents, and are not described in detail herein. Briefly, the silver halide emulsion as one component of the photographic material of this invention is prepared in quite the same way as in usual and known black-and-white emulsions, or by merely diluting ordinary black-and-white emulsions with an aqueous solution of a binder without the need for any special precautions, so long as the content of silver is drastically reduced.

The silver halide emulsion is coated on the layer of the copper compound and the hydrophilic binder which is formed on the support. Subsequent drying provides the photographic material of this invention. The coating and drying can be performed in quite the same way as described hereinabove with regard to the formation of a layer containing the copper compound and the hydrophilic binder. The dry thickness of the resulting silver halide emulsion layer is about 0.1 μm to about 20 μm, preferably 1 μm to 10 μm. The concentration of the emulsion, that is, primary the ratio of the binder to the solvent (mainly water), can be appropriately selected. The amount of the binder is about 1.5 to about 10% by weight, preferably 3 to 7% by weight, based on water. The hardening or spectral sensitization treatment can be performed by incorporating the hardening agent or the sensitizer in the coating solution, or after the coating step.

The method for image recording using the photographic material of this invention prepared in the manner described hereinabove as a further embodiment of this invention is described in detail below.

The photographic material is exposed imagewise. The silver halide exposed is developed to metallic silver, and if desired, fixed. Then, the material is treated with a chemical developer solution (an aqueous solution of a reducing agent) in order to form a non-silver image (metallic copper or copper oxide) from the copper salt or complex using the developed silver as a catalyst. The ıaterial is then washed with water, and dried to form a ermanent image. The development of the silver halide nd the development of the copper compound can be erformed continuously in one chemical developer olution, if desired.

Various light sources which emit visible rays and/or ltraviolet rays can be used for exposure. A suitable vavelength which can be used for exposure ranges rom about that of X rays up to about 700 nm. Examples f light sources include a tungsten lamp, a xenon lamp, mercury lamp, a carbon arc lamp, and a halogen lamp. Vhere a high speed silver halide emulsion is used pho- ographing can be by using a camera under natural ght. X-rays and electron beams can also be used for nage recording. Exposure can be performed through n image-bearing transparency, or by reflection. The esponse of the non-silver image obtained by the photo- raphic material of the invention to the amount of light orresponds substantially to that of the vacuum-depos- ed or sputtered silver halide or the silver halide emul- ion. For example, when exposure is carried out using n optical wedge, the number of visible wedge steps of he developed silver corresponds substantially to that of he non-silver image obtained by development using the eveloped silver. In other words, the sensitivity of the on-silver image is determined by the sensitivity of the acuum-deposited or sputtered silver halide or the sil- er halide emulsion, and is equivalent thereto. It should e pointed out however that when some types of copper ompounds are used, the photosensitivity of the silver alide layer provided in intimate contact with the cop- er compound layer is decreased by a factor of about /10 to 1/100 of the photosensitivity of the silver halide ayer not in contact therewith. This desensitization can e avoided by appropriately selecting the compositions f both layers. The time required for exposure can be aried over a wide range according, for example, to the rain size of the silver halide and whether or not a ensitization treatment of the silver halide has been mployed. For example, when exposure is made using ight rays from a 100 W tungsten-filament electric lamp t a distance of 30 cm, the exposure time is about 0.01 to bout 60 seconds, preferably 0.1 to 20 seconds, for the acuum-evaporated or sputtered silver halide layer, and bout 0.01 to about 10 seconds, preferably 0.05 to 1 econd, for the silver halide emulsion layer.

The development of the exposed silver halide and the levelopment of the copper compound to a non-silver mage using the developed silver as a catalyst are per- ormed using an aqueous solution of a reducing agent chemical developer solution). The developing agent sed for the chemical developer solution can be a single ompound or a mixture of compounds selected, for xample, from 4-aminophenols typified by 4-N-methyl- minophenol hemisulfate (commonly called Metol), -N-benzyl-aminophenol hydrochloride, 4-N,N-dieth- l-aminophenol hydrochloride, and 4-aminophenol sul- ate, 3-pyrazolidones such a 1-phenyl-3-pyrazolidone ,4-dimethyl-1-phenyl-3-pyrazolidone, and 4-methyl-1- henyl-3-pyrazolidone, polyhydroxybenzenes such as ydroquinone, 2-methylhydroquinone, 2-phenylhy- roquinone, 2-chlorohydroquinone, pyrogallol, and atechol, p-phenylenediamines such as p-phenylenedia- nine hydrochloride and N,N-diethyl-p-phenylenedia- nine hydrochloride, ascorbic acid, N-(p-hydroxyphe- yl) glycine, paraformaldehyde, formaldehyde, and the ompounds described as developing agents in L. F. A. Mason, *Photographic Processing Chemistry,* pages 16 to 30, Oxford Press (1966), or in C. E. K. Mees and T. H. James, *The Theory of Photographic Process,* 3rd Edition, Chapter 13, Macmillan Co. (1966). The borane compounds described in U.S. Pat. No. 3,650,748, such as amine borane, phosphine borane, arsine borane or stibine borane, can also be used. Inorganic compounds, such as sodium dithionite or sodium borohydride, can also be used as the developing agents.

In addition to the developing agent, various additives can be incorporated in the developer solution in order to improve the development characteristics (e.g., the speed of development), or the quality of the resulting images (e.g., the inhibition of fog formation). Typical examples of these additives include alkali agents (e.g., the hyroxides, carbonates or phosphates of alkali metals or ammonia), pH adjusters or buffers (e.g., weak acids such as acetic acid or boric acid, weak bases, or salts of weak acids or bases), development accelerators (e.g., the various pyridinium compounds or cationic compounds disclosed in U.S. Pat. Nos. 2,648,604 and 3,671,247, potassium nitrate, sodium nitrate, polyethylene glycol condensates or their derivatives disclosed, for example, in U.S. Pat. Nos. 2,533,990, 2,577,127, and 2,950,970, nonionic compounds such as polythioethers typified by the compounds disclosed in British Pat. Nos. 1,020,033 and 1,020,032, organic amines such as pyridine or ethanolamine, benzyl alcohol, and hydrazines), fog inhibitors (e.g., alkali metal bromides, alkali metal iodides, the nitrobenzimidazoles disclosed in U.S. Pat. Nos. 2,496,940 and 2,656,271, mercaptobenzimidazole, 5-methylbenzotriazole, 1-phenyl-5-mercaptotetrazole, the compounds for rapid processing solutions disclosed in U.S. Pat. Nos. 3,113,864, 3,342,596, 3,295,976, 3,615,522, and 3,597,199, the thiosulfonyl compounds disclosed in British Pat. No. 972,211, the phenazine-N-oxides disclosed in Japanese Patent Publication No. 41,675/71, and the antifoggants disclosed at pages 29 to 47 of a Japanese-language publication entitled *Scientific Photography,* 2nd Volume), stainor sludge-inhibitors, and antioxidants (e.g., sulfite salts, bisulfite salts, hydroxylamine hydrochloride, formaldehyde-hybisulfite adducts, or alkalnolamine-bisulfite adducts).

The development of silver halide differs from that of the copper compound in regard to the ease of development or the speed of development because there is a difference in their oxidation-reduction potentials or solubilities in the developer solution. Accordingly, the developer solutions can be prepared by choosing reducing agents suitable for the respective developments from the above-described developing agents, their concentrations, and the pH of the developer solutions. Developer solutions for silver halide in the present invention need not to be special, and can be prepared according to known formulations disclosed in the above-cited literature references and patents or by using commercially available developing agents. Especially preferred developing agents for the copper compounds include, for example, paraformaldehyde, formaldehyde, amineboranes (e.g., dimethylamineborane or diethylamineborane), sodium borohydride, L-ascorbic acid, pyrazolidones, aminophenols, and polyhydroxybenzenes. Since developing agents for copper compounds are generally effective also for the development of silver halide, the developments of the silver halide and the copper compound can be carried out simultaneously in one bath using such developing agents.

The concentration of the developing agent employed varies greatly according to the type of the developing agent used. Generally, a preferred concentration is about 1 to about 15% by weight based on water. The pH of the developer solution is about 4 to about 14, preferably 5 to 13.

The concentrations of additives to be incorporated in the developer solution as required can be determined on the basis of the disclosures of the above cited litrature references and patents.

The time required for development generally ranges from about 1 second to about 2 minutes, preferably from 10 seconds to 1 minute, in the case of the vacuum-deposited or sputtered silver halide, and from about 30 seconds to about 15 minutes, preferably from 1 minute to 10 minutes, in the case of the silver halide emulsion. The temperature generally employed for development is about 10° to about 50° C., preferably 18° to 40° C., in both cases. For the development of the copper compound, the time generally required ranges from about 30 seconds to about 20 minutes, preferably from 1 minute to 10 minutes, and the temperature generally employed is about 20° to about 80° C., preferably 23° to 70° C.

When the development of the copper compound is performed immediately after the development of silver halide, the silver halide remaining in the unexposed area is generally reduced in the developer solution for the copper compound with metallic silver precipitating which becomes a catalyst for the development of the copper compound, thereby forming fog. The fog can be removed by adjusting the time for developing the copper compound and the composition of the developer solution (e.g., the concentration of the developing agent, or the pH of the developer solution). Or the removal of fog can be effected by subjecting the photographic material to a fixation treatment after the development of the silver halide but before the development of the copper compound.

Fixing agents and the composition of the fixing bath can be those generally known for the fixation of silver halide. They can be selected on the basis of the disclosures of the literature such as C. E. K. Mees and T. H. James, *The Theory of Photographic Process,* supra, or commercially available fixing agents can be used. Specific examples of suitable fixing agents are sodium thiosulfate, sodium sulfite, potassium thiocyanide, and potassium iodide. The time generally employed for fixation is about 10 seconds to about 3 minutes, and the temperature employed is about 18° to about 40° C. If too long a time is consumed for treatment with the fixing bath, the catalytic activity of the developed silver for the development of the copper compounds is sometimes reduced. Hence, the actual fixation time used should be determined on a trial-and-error basis. Since the copper compound is not sensitive to light rays in the visible region, the fixation of the copper compound after development is not required.

The photographic materials of this invention can be used for general purposes, for example, as black-and-white photographic papers, slides, or photographic films. They can also be used as photographic materials for process work.

The photographic materials of this invention and the process for recording non-silver images using such photographic materials are described more specifically by the following Examples and Comparative Examples. Unless otherwise indicated, all amounts of the compounds used are by weight and similarly for parts, percents and ratios, and where no temperature is indicated, the process steps were performed at room temperature (23° to 28° C.). Further, all thicknesses set forth are on a dry basis.

EXAMPLES 1 TO 15

100 mg of each of the copper complexes or salts shown in Table 1 below and 400 mg of cellulose acetate (with an acetylation degree of 55%) were dissolved or dispersed in 5 ml of N,N-dimethylformamide, and the resulting coating solution or dispersion was coated on a 100 μm-thick polyethylene terephthalate film using a rod coater, and dried at 60° C. for 1 hour to obtain transparent films having a copper compound-containing layer formed on the support in a thickness of 6 μm.

Then, using a vacuum-deposition device (EBH-6 type, a product of Nippon Shinku (ULVAC)), silver bromide was vacuum-deposited on the resulting layer. Specifically, the coated surface of the film was directed toward a vapor source and set at a position 40 cm away from the vapor source. A silver bromide was placed in a molybdenum boat as the vapor source. Then, the vacuum chamber was evacuated to a vacuum degree of $4\times10^{-5}$ to $8\times10^{-5}$ torr, and the vapor source was heated electrically. One to two minutes later, the shutter was opened, and the vacuum-deposition of silver bromide was started. The amount of silver bromide vacuum-deposited was monitored using a deposited film thickness gage (DTM-200 type, a product of Sloan Co.), and when the thickness reached 50 nm, the shutter was closed.

Each of the resulting photographic materials was brought into intimate contact with an optical wedge (optical density difference per step 0.1) made of a silver halide photographic film, and exposed through it for 6 seconds to light from a 100 W tungsten lamp light source at a distance of 30 cm. The exposed material was then processed with a developer of the formula

| Formulation of the Developer Solution | parts |
|---|---|
| p-N-Methylaminophenol Sulfate | 2.5 |
| Sodium Sulfite (anhydrous) | 100 |
| Hydroquinone | 2.5 |
| Borax | 2 |
| Potassium Bromide | 0.5 |
| Water to make | 1000 |

to develop the silver bromide layer at 20° C. for 20 seconds. Then, using a fixation bath of the formula

| Formulation of the Fixation Bath | parts |
|---|---|
| Water | 100 |
| Sodium Thiosulfate | 5 |
| Sodium Sulfite (anhydrous) | 5 |

the developed material was fixed at 20° C. for 30 seconds, and then washed with water for 30 seconds. Thus, a pale yellowish brown silver image was seen in a wedge-like shape. All of the steps from the vacuum deposition of silver bromide to the rinsing were carried out in a darkroom (under a red safety lamp). Then, under room light, the film so treated was dipped in a developer solution (pH 13) comprising 130 g of paraformaldehyde, 120 g of potassium hydroxide, and 1 liter of water, and developed for 10 minutes at 60° C. Reddish brown to black non-silver images were formed corresponding to the silver images. When the developed films were washed with water, all the images turned black. The results obtained are shown in Table 1 below.

When the same procedure as above was performed except that the copper complex or salt was not used, a silver image was similarly visible, but even on treatment with paraformaldehyde, there was no change either in image density or color.

The copper complexes used in these Examples were synthesized in accordance with the methods disclosed in U.S. Pat. Nos. 3,859,092, 3,860,500, 3,860,501, and 3,880,724. In Table 1, Dm represents the maximum optical density of the image, and Dfog, the optical density of the fog, both in the visible region.

TABLE 1

| Example No. | Image-forming Material | Dm of Silver Image | Non silver Image + Silver Image | | |
|---|---|---|---|---|---|
| | | | Number of Wedge Steps | Dm | Dfog |
| 1 | $Cu[P(C_6H_5)_3]_2BH_4$ | 0.13 | 2 | 0.60 | 0.05 |
| 2 | $Cu[NC(CH_2)_4CN]NO_3$ | 0.09 | 3 | 0.87 | 0.03 |
| 3 | $Cu[NC(CH_2)_2CN]_2NO_3$ | 0.10 | 3 | 0.85 | 0.02 |
| 4 | $Cu[Sb(C_6H_5)_3]_3NO_3$ | 0.12 | 2 | 0.43 | 0.08 |
| 5 | $Cu[H_2N(CH_2)_2NH_2]_2[B(C_6H_5)_4]_2$ | 0.14 | 2 | 0.50 | 0.06 |
| 6 | $Cu(C_5H_5N)_2Cl_2$ | 0.09 | 2 | 0.62 | 0.06 |
| 7 | Cu (II) Acetylacetonate | 0.12 | 1 | 0.34 | 0.02 |
| 8 | Copper (II) Acetate | 0.15 | 1 | 0.40 | 0.02 |
| 9 | Copper (II) Citrate | 0.11 | 1 | 0.32 | 0.02 |
| 10 | Copper (II) Benzoate | 0.12 | 2 | 0.44 | 0.03 |
| 11 | Copper (II) Stearate | 0.10 | 1 | 0.29 | 0.02 |
| 12 | Copper (I) Chloride | 0.11 | 4 | 1.04 | 0.07 |
| 13 | Copper (I) Bromide | 0.10 | 3 | 0.72 | 0.06 |
| 14 | Copper (I) Hydroxide | 0.12 | 4 | 0.93 | 0.04 |
| 15 | Copper (II) Nitrate | 0.08 | 2 | 0.67 | 0.06 |

EXAMPLE 16

When the same procedure as in Example 12 was repeated except that the deposited film thickness of the silver bromide was changed to 15 nm instead of 50 nm, a black non-silver image was obtained which had a Dm of 0.85 and a Dfog of 0.04. (The silver image had a Dm of 0.08.)

EXAMPLE 17

When the same procedure as in Example 12 was repeated except that a 1:1 (weight ratio) mixture of silver bromide and silver chloride was used as the vapor source to form a vacuum-deposited silver halide layer with a thickness of 50 nm, a black non-silver image was obtained which had a Dm of 0.97 and a Dfog of 0.05. (The silver image had a Dm of 0.10.)

EXAMPLES 18 TO 20

The same procedure as in Example 2 was repeated except that each of the hydrophilic binders shown in Table 2 was used. The results obtained are also shown in Table 2.

TABLE 2

| Example No. | Hydrophilic Binder | | Non-silver Image + Silver Image | |
|---|---|---|---|---|
| | | | Dm | Dfog |
| 18 | Cellulose Acetate (acetylation degree 45%) | 400 mg | 0.97 | 0.05 |
| 19 | Cellulose Acetate (acetylation degree 55%) | 300 mg | 1.03 | 0.06 |
| | Polyvinyl Pyrrolidone | 100 mg | | |
| 20 | Gelatin (hardened with formaldehyde) | 300 mg | 0.90 | 0.03 |
| | (In this example, the coating solution prepared using 5 ml of water instead of the dimethyl formamide) | | | |

TABLE 2-continued

EXAMPLE 21

When the same procedure as in Example 12 was repeated except that the film was developed at 20° C. for 30 seconds using a developer of the formula

| Formulation of the Developer | parts |
|---|---|
| p-N-Methylaminophenol Sulfate | 3 |
| Anhydrous Sodium Sulfite | 30 |
| Hydroquinone | 2.5 |
| Fuji Nabox (a complex of barax and potassium hydroxide produced by Fuji Photo Film Co., Ltd.) | 12 |
| Potassium Bromide | 0.5 |
| Water to make | 1000 |

to develop the silver halide layer after exposure, the silver image obtained was gray and had a Dm of 0.22. The number of wedge steps increased by about 2. When the chemical development of the copper compound was performed in the same way as in Example 12, a black non-silver image was formed which had a Dm of 0.98 and a Dfog of 0.06.

EXAMPLES 22 AND 23

When the same procedure as in Example 12 was repeated except that each of the developer solutions shown in Table 3 was used as a chemical developer for the copper compound instead of the paraformaldehyde developer solution. Black non-silver images were obtained with the results obtained shown in Table 3.

TABLE 3

| Example No. | Developer Composition | | Development Conditions | | Non-silver Image + Silver Image | |
|---|---|---|---|---|---|---|
| | | | Temperature (°C.) | Time (min.) | Dm | Dfog |
| 22 | Dimethylamine-borane | 0.6 g | 40 | 5 | 1.05 | 0.20 |

TABLE 3-continued

| Example No. | Developer Composition | | Development Conditions Temperature (°C.) | Time (min.) | Non-silver Image + Silver Image Dm | Dfog |
|---|---|---|---|---|---|---|
| | Triethanolamine | 1 g | | | | |
| | Sodium Hydroxide | 0.5 g | | | | |
| | Water | 100 ml | | | | |
| 23 | Ascorbic Acid | 10 g | 50 | 10 | 0.75 | 0.06 |
| | Diethanolamine | 5 g | | | | |
| | Sodium Hydroxide | 10 g | | | | |
| | Water | 100 mg | | | | |

EXAMPLE 24

A photographic material having formed thereon a silver bromide layer by vacuum deposition in the same manner as in Example 12 was spectrally sensitized by being dipped for 1 minute in a 0.05% by weight methanol solution of 1,1'-diethyl-2,2'-cyanine bromide, dried in air, and then treated in the same way as in Example 12. A black non-silver image was obtained which had a Dm of 1.20 and a Dfog of 0.10, and the number of wedge steps was increased by 7 as compared with Example 12.

COMPARATIVE EXAMPLE 1

The formation of images in accordance with the photographic material of this invention (the "inner type") was compared with an "external type" copper ion physical development. 400 mg of cellulose acetate (acetylation degree 55%) was dissolved in 5 ml of N,N-dimethylformamide, and in the same manner as in Examples 1 to 15, the solution was coated on a polyethylene terephthalate film, and dried. Followed by vacuum deposition of a silver bromide layer to a thickness of 50 nm.

The photographic material obtained was exposed and developed in the same manner as in Examples 1 to 15 to form a pale yellowish brown silver image which had a Dm of 0.11. When the film was then dipped in a commercially available copper plating liquor (containing 18% of formaldehyde, a product of Okuno Seiyaku Kabushiki Kaisha) at 40° C. for 20 minutes, no copper image appeared.

COMPARATIVE EXAMPLES 2 TO 7

The photographic material of this invention was compared with the photographic materials containing photosensitive copper complexes (disclosed in U.S. Pat. Nos. 3,859,092, 3,860,500, 3,860,501, and 3,880,724).

100 mg of each of the copper complexes shown in Table 4 below and 400 mg of cellulose acetate (acetylation degree 55%) were dissolved or dispersed in 5 ml of N,N-dimethylformamide. Each of the resulting solutions or dispersions was coated on a polyethylene terephthalate film having a thickness of 100 μm using a rod coater, and dried at 60° C. for 1 hour to form a 6μm-thick layer containing the copper compound. The resulting photographic material was divided into two portions. One portion was brought into intimate contact with a transparent mask made of a silver halide photographic film bearing a typed image, and exposed for 30 seconds to light from a 100 W tungsten-filament electric lamp set 30 cm away from the material. The other portion was brought into intimate contact with the same mask, and exposed for 10 seconds to light from a 250 W super high-pressure mercury lamp disposed 50 cm away from the material. (Comparative Examples 2 to 4.) For comparison, the photographic materials of Examples 1, 2 and 5 (for Comparative Examples 5 to 7) were each divided into two portions, and exposed in the same way as set forth above to light from both a tungsten lamp and a mercury lamp.

Each of the exposed films was processed with the developer of Examples 1 to 15 and the fixing bath, washed with water, and treated with a developer containing paraformaldehyde and potassium hydroxide successively in quite the same manner as set forth in Examples 1 to B 15. The results obtained are shown in Table 4.

TABLE 4

| Comparative Example No. | Copper Complexes | Image Density: Exposed to a Tungsten Lamp Light | Image Density: Exposed to a Mercury Lamp Light |
|---|---|---|---|
| 2 | $Cu[P(C_6H_5)_3]_2BH_4$ | 0.01 | 0.35 |
| 3 | $Cu[NC(CH_2)_4CN]_2NO_3$ | 0.01 | 0.22 |
| 4 | $Cu[H_2N(CH_2)_2NH_2]_2[B(C_6H_5)_4]_2$ | 0.01 | 0.15 |
| 5 | Copper Complex used in Example 1 | 0.62 | 0.85 |
| 6 | Copper Complex used in Example 2 | 0.85 | 0.97 |
| 7 | Copper Complex used in Example 5 | 0.53 | 0.62 |

EXAMPLES 25 TO 51

One part of each of the copper complexes or salts shown in Table 5 below and 4 parts of cellulose acetate (L-40, a trademark for Daicel K.K., degree of acetylation 55%, average degree of polymerization: (160) were dissolved in 50 parts of N,N-dimethylformamide. The resulting coating solution was coated on a 100 μm-thick polyethylene terephthalate film (support) using a rod coater, and dried at 60° C. for 1 hour to form a transparent film having a 6 μm-thick copper compound containing layer formed on the support.

On the other hand, 1 part of a 1% aqueous solution of formaldehyde as a hardening agent was added to 100 parts of a black-and-white photographic silver bromide emulsion (average grain size 0.8 μm; in all of the examples, the binder used was gelatin) diluted to 100 times with a 6% aqueous solution of gelatin. Ten minutes later, the mixture was coated on the copper compound-containing layer formed on the support using a rod coater, and dried at 40° C. for 1 hour to prepare a photographic material in accordance with this invention. After drying, the thickness of the emulsion layer was 4 μm. The amount of silver halide contained in this photographic material, determined by fluorescent X-ray analysis, was 0.2 g/m$^2$ calculated as metallic silver.

The resultant photographic material was brought into intimate contact with an optical wedge (optical density difference per step: 0.1) made of a silver halide dry plate, and exposed for 1 second through the wedge to light from a 100 W tungsten lamp disposed 30 cm away from the material, and then the material was dipped for 5 minutes in a developer solution of the following fornulation at 20° C. to develop the silver halide. A pale yellowish brown silver image appeared in the form of a wedge.

| Formulation of the Developer Solution | parts |
|---|---|
| p-N-Methylaminophenol Sulfate | 2.5 |
| Sodium Sulfite (anhydrous) | 100 |
| Hydroquinone | 2.5 |
| Borax | 2 |
| Potassium Bromide | 0.5 |
| Water to make | 1000 |

Then, the developed photographic material was vashed with running water for 1 minute, and then lipped in a developer solution of 1.3 parts of paraformldehyde, 1.2 parts of potassium hydroxide and 10 parts of water to develop the copper compound layer at 60° C. for 5 minutes. A reddish brown or black non-silver mage was formed which corresponded to an intensified orm of the silver image. When the processed materials vere washed with water for 1 minute, all non-silver mages turned black. The results obtained are shown in Table 5 below.

When the same photographic materials were prepared except that no copper compound was used, and exposed and processed for development of silver halide in the same manner as above, pale yellowish brown silver images were obtained (the number of steps of the visible wedge-shaped image increased by 2 to 10 over the case of using the copper compound). However, subsequent treatment of the silver images with an alkali aqueous solution of paraformaldehyde did not cause any change to occur in their density or color.

TABLE 5

| Example No. | Copper Compound (image-forming substances) | Silver Image*1 | | | Non-silver Image + Silver Image*2 | | |
|---|---|---|---|---|---|---|---|
| | | Number of Wedge Steps*3 | Dm*4 | Dfog*5 | Number of Wedge Steps*3 | Dm*4 | Dfog*5 |
| 25 | $Cu[P(C_6H_5)_3]_2BH_4$ | 11 | 0.15 | 0.02 | 12 | 1.50 | 0.30 |
| 26 | $Cu[P(C_6H_5)_3]_3BH_3CN$ | 12 | 0.13 | 0.02 | 13 | 1.30 | 0.15 |
| 27 | $Cu[P(C_6H_5)_3]_4B(C_6H_5)_4$ | 11 | 0.20 | 0.03 | 13 | 1.70 | 0.10 |
| 28 | $Cu[P(C_6H_4\text{-}CH_3)_3]_2Cl$ | 10 | 0.17 | 0.02 | 12 | 1.45 | 0.15 |
| 29 | $Cu[P(C_6H_5)_3]_2NO_3$ | 11 | 0.18 | 0.03 | 12 | 1.75 | 0.20 |
| 30 | $Cu[Sb(C_6H_5)_3]_3NO_3$ | 11 | 0.18 | 0.03 | 13 | 1.40 | 0.15 |
| 31 | $Cu[P(OCH_3)_3]BH_3CN$ | 11 | 0.20 | 0.03 | 13 | 1.25 | 0.20 |
| 32 | $Cu[P(OCH_3)_3]_4B(C_6H_5)_4$ | 10 | 0.13 | 0.02 | 12 | 1.80 | 0.10 |
| 33 | $Cu[NC(CH_2)_2CN]_2NO_3$ | 12 | 0.12 | 0.02 | 14 | 2.10 | 0.20 |
| 34 | $Cu[NC(CH_2)_4CN)_2NO_3$ | 12 | 0.13 | 0.02 | 13 | 1.90 | 0.15 |
| 35 | $Cu[H_2N(CH_2)_2NH_2]_2[B(C_6H_5)_4]_2$ | 12 | 0.14 | 0.03 | 13 | 1.75 | 0.15 |
| 36 | $Cu[H_2N(CH_2)_2NH_2]_2Br_2$ | 12 | 0.16 | 0.02 | 12 | 1.55 | 0.20 |
| 37 | $Cu[C_5H_5N]_2Cl_2$ | 11 | 0.17 | 0.03 | 12 | 1.80 | 0.15 |
| 38 | Copper (I) Chloride | 8 | 0.10 | 0.02 | 10 | 2.30 | 0.25 |
| 39 | Copper (I) Bromide | 9 | 0.12 | 0.02 | 10 | 2.15 | 0.30 |
| 40 | Copper (I) Hydroxide | 9 | 0.11 | 0.02 | 11 | 2.45 | 0.15 |
| 41 | Copper (I) Thiocyanate | 8 | 0.11 | 0.03 | 10 | 1.70 | 0.15 |
| 42 | Copper (II) Nitrate | 7 | 0.19 | 0.02 | 9 | 2.10 | 0.25 |
| 43 | Copper (II) Sulfate | 7 | 0.12 | 0.03 | 8 | 2.35 | 0.20 |
| 44 | Copper (II) Formate | 9 | 0.19 | 0.02 | 10 | 1.55 | 0.15 |
| 45 | Copper (II) Acetate | 8 | 0.21 | 0.03 | 9 | 1.40 | 0.25 |
| 46 | Copper (II) Caproate | 10 | 0.17 | 0.03 | 10 | 2.05 | 0.10 |
| 47 | Copper (II) Moristate | 10 | 0.15 | 0.03 | 9 | 1.90 | 0.20 |
| 48 | Copper (II) Stearate | 11 | 0.17 | 0.02 | 12 | 0.95 | 0.20 |
| 49 | Copper (II) Citrate | 11 | 0.20 | 0.03 | 11 | 1.45 | 0.15 |
| 50 | Copper (II) Benzoate | 12 | 0.09 | 0.02 | 13 | 1.50 | 0.10 |
| 51 | Copper (II) Acetylacetonate | 11 | 0.12 | 0.02 | 10 | 1.00 | 0.05 |

Note
*1The image obtained after exposure, development of silver halide, and rinsing
*2The image obtained finally after exposure, development of silver halide, rinsing, development of the copper compound, and rinsing
*3The number of steps of the wedge-like image that could be observed by the naked eye
*4The maximum image density (including fog)
*5The fog density of the unexposed area

EXAMPLES 52 TO 54

The same procedure as in Example 38 was repeated except that the silver bromide emulsion was diluted with a 6% aqueous solution of gelatin to the ratios shown in Table 6 below. The results obtained are shown in Table 6. The Dm, Dfog and the number of wedge steps have the same meanings as defined in the footnotes to Table 5. The same definitions will also apply to subsequent examples.

TABLE 6

| Example No. | Ratio of Dilution | Amount of Silver | Silver Image | | | Non-silver Image + Silver Image | | |
|---|---|---|---|---|---|---|---|---|
| | | | Number of Wedge Steps | Dm | Dfog | Number of Wedge Steps | Dm | Dfog |
| 52 | 200 | 0.1 | 7 | 0.10 | 0.02 | 10 | 2.15 | 0.15 |
| 53 | 500 | 0.04 | 6 | 0.05 | 0.02 | 9 | 1.70 | 0.05 |
| 54 | 1000 | 0.02 | 4 | 0.02 | 0.02 | 6 | 0.85 | 0.03 |

EXAMPLES 55 TO 57

The same procedure as in Example 34 was repeated except that instead of the silver bromide emulsion, each of the emulsions indicated in Table 7 below, diluted to 100 times with a 6% aqueous solution of gelatin, was coated at a thickness in the dried state of 2 μm, and the time of developing the copper compounds was changed as shown in Table 7. The results are shown in Table 7. All of the resulting non-silver images were black.

TABLE 7

| Example No. | Type and Mixing Ratio of Silver Malide Emulsions | Average Grain Size of Silver Halide (μm) | Developing Time for the Copper Compound (min.) | Silver Image: Number of Wedge Steps | Silver Image: Dm | Silver Image: Dfog | Non-silver Image + Silver Image: Number of Wedge Steps | Non-silver Image + Silver Image: Dm | Non-silver Image + Silver Image: Dfog |
|---|---|---|---|---|---|---|---|---|---|
| 55 | Silver iodobromide (96 mole % of silver bromide and 4 mole % of silver iodide) | 0.4 | 5 | 21 | 0.20 | 0.02 | 22 | 2.35 | 0.15 |
| 56 | Silver chlorobromide (40 mole % of silver chloride and 60 mole % of silver bromide) | 0.3 | 3 | 11 | 0.15 | 0.02 | 13 | 2.20 | 0.20 |
| 57 | Silver Chloride | 0.7 | 2 | 7 | 0.10 | 0.03 | 8 | 1.80 | 0.25 |

EXAMPLES 58 AND 59

The same procedure as in Example 55 was repeated except that the silver iodobromide emulsion was diluted to 100 times with a 6% aqueous solution of gelatin and 1 parts of a 0.005% aqueous solution of each of the sensitizing dyes shown in Table 8 below was added per 100 parts of the emulsion solution as a spectral sensitizing dye, and the exposure was performed for 0.1 second. Black non-silver images were obtained. The results obtained are shown in Table 8.

TABLE 8

| Example No. | Sensitizing Dye | Non-silver Image + Silver Image: Number of Wedge Steps | Dm | Dfog |
|---|---|---|---|---|
| 58 | 3,3'-Diethylthiacarbocyanine iodide | 15 | 2.05 | 0.20 |
| 59 | 3,3'-Diethyl-4,5,4',5'-dibenzothiacarbocyanine bromide | 13 | 1.80 | 0.15 |

EXAMPLE 60

Using the photographic material prepared in Example 58, an outdoor scene was photographed on a fine day using a camera with an F-number of 2.8 and an exposure time of 1/25 second, instead of exposing the material with light from a tungsten lamp. An image was formed in quite the same manner as in Example 58. A black negative image of good quality was recorded.

EXAMPLES 61 TO 63

In quite the same manner as set forth in Example 42, photographic materials were produced and images were formed except that 0.7 part of copper (II) nitrate and each of the hydrophilic binders indicated in Table 9 below in the amounts indicated were dissolved in each of the solvents indicated in Table 9 in the amounts indicated. Black non-silver images were obtained. The results obtained are shown in Table 9.

TABLE 9

| Example No. | Hydrophilic Binder: Compound | Hydrophilic Binder: Amount (parts) | Solvent: Compound | Solvent: Amount (parts) | Non-silver Image + Silver Image: Number of Wedge Steps | Dm | Dfog |
|---|---|---|---|---|---|---|---|
| 61 | Cellulose Acetate (LL-10, a product of Daicel K.K., Acetylation degree: about 45%; polymerization degree: about 110) | 5 | Acetone<br>Water | 45<br>5 | 11 | 2.55 | 0.30 |
| 62 | Cellulose Acetate (L-40, a product of Daicel K.K., acetylation degree: 55%; average degree of polymerization: 160)<br>Polyvinylpyrrolidone (K-90, a product of Wako Junyaku Kogyo K.K., average molecular weight: about 40,000) | 3 | N,N-Dimethyl-formamide | 50 | 12 | 2.70 | 0.25 |
| 63 | Photographic Gelatin | 3 | Water<br>1% Formaldehyde | 49<br>1 | 8 | 1.80 | 0.15 |

EXAMPLE 64

The same procedure as in Example 38 was repeated except that a developer solution of the following formulation was employed as a developer for silver halide, and the exposed photographic material was developed at 20° C. for 3 minutes using this developer.

| Formulation of the Developer | parts |
|---|---|
| p-N-Methylaminophenol Sulfate | 3 |
| Anhydrous Sodium Sulfite | 30 |
| Hydroquinone | 2.5 |
| Fuji Nabox (a complex of borax and potassium hydroxide produced by Fuji Photo Film Co., Ltd.) | 12 |
| Potassium Bromide | 0.5 |
| Water to make | 1000 |

As a result, a final black image (non-silver image+silver image) with a wedge step number of 12, a Dm of 2.05 and a Dfog of 0.15 was obtained. The silver image obtained after development of the silver halide had a wedge step number of 10, a Dm of 0.20 and a Dfog of 0.02 and was gray in color.

EXAMPLES 65 TO 68

The same procedure as in Example 43 was repeated except that each of the developer solutions indicated in Table 10 below was used for forming a non-silver image from the copper compound, and the development was performed at the temperatures and for the periods of time indicated in Table 10. Black non-silver images were obtained. The results obtained are shown in Table 10.

TABLE 10

| Example No. | Developer Solution: Compounds | Developer Solution: Amount (parts) | Developing Conditions: Temperature (°C.) | Developing Conditions: Time (min.) | Non-Silver Image + Silver Image: Number of Wedge Steps | Dm | Dfog |
|---|---|---|---|---|---|---|---|
| 65 | Dimethylamineborane | 0.6 | 40 | 5 | 8 | 1.70 | 0.25 |
| | Triethanolamine | 1 | | | | | |
| | Sodium Hydroxide | 0.5 | | | | | |
| | Water | 100 | | | | | |
| 66 | L-Ascorbic Acid | 10 | 50 | 10 | 7 | 1.35 | 0.05 |
| | Diethanolamine | 5 | | | | | |
| | Sodium Thiosulfate | 0.2 | | | | | |
| | Water | 100 | | | | | |
| 67 | Sodium Dithionite ($Na_2S_2O_4$) | 8 | 60 | 5 | 7 | 1.50 | 0.10 |
| | Water | 100 | | | | | |
| 68 | Sodium Borohydride | 10 | 60 | 5 | 8 | 1.65 | 0.15 |
| | Water | 100 | | | | | |

EXAMPLE 69

The same procedure as in Example 38 was repeated except that after development of the silver halide, fixation was performed at 25° C. for 15 seconds in a fixation bath of the following formulation, followed by the same treatment as in Example 38.

| Formulation of the Fixation Bath | parts |
|---|---|
| Water | 100 |
| Sodium Thiosulfate | 5 |
| Sodium Sulfite (anhydrous) | 5 |

A final black image (non-silver image+silver image) having a wedge step number of 8, a Dm of 1.75 and a Dfog of 0.08 was obtained.

EXAMPLE 70

The same procedure as in Example 38 was repeated except that baryta paper was used as the support. A final black image (non-silver image+silver image) having a wedge step number of 12, a Dm (reflection density) of 2.05 and a Dfog (reflection density) of 0.20 was obtained.

COMPARATIVE EXAMPLE 8

The image formation ("inner type") using the photographic material of this invention was compared with an "external type" copper ion physical development.

A photographic material, same as in Example 25 except that the copper complex was omitted from the hydrophilic binder layer, was prepared. Specifically, an N,N-dimethylformamide solution of cellulose acetate was coated on the support, and dried, and on the layer was coated a diluted silver bromide emulsion, followed by drying.

The resulting photographic material was exposed in the same manner as in Example 25. The silver halide was developed, and the material washed with water. A yellowish brown silver image having a wedge step number of 15, a Dm of 0.20 and a Dfog of 0.02 was obtained. When the resulting film was dipped in a commercially available copper plating liquor (a product of Okuno Seiyaku K. K. containing 18% of formaldehyde as a reducing agent) at 50° C. for 10 minutes. The silver image was not intensified with the copper, but a reddish brown fog occurred on the entire surface (Dfog 0.55).

COMPARATIVE EXAMPLES 9 TO 14

The photographic material of this invention was compared with the photographic materials containing photosensitive copper complexes disclosed in U.S. Pat. Nos. 3,859,092, 3,860,501, and 3,880,724.

One part of each of the copper complexes shown in Table 11, below and 4 parts of cellulose acetate (described in Examples 25 to 51) were dissolved in 50 parts of N,N-dimethylformamide. The solution was coated on the same polyethylene terephthalate film as used in Examples 25 to 51, and dried to form a copper complex layer having a thickness of 6 μm (the photographic materials described in the above-cited U.S. Patents). (Comparative Examples 9 to 11)

For comparison, the films shown in Examples 25, 32 and 35 (containing the copper complexes corresponding respectively to Comparative Examples 9 to 11) were used as such. (Comparative Examples 12 to 14)

The photographic sensitivities of these photographic materials were compared both under rays in the visible region and under ultraviolet rays. A transparency containing a typed image was brought into intimate contact with each of the photographic materials, and the material exposed through it. In the case of visible ray exposure, the photographic material was exposed for 5 seconds to light from a 100 W tungsten lamp as a light source disposed 30 cm away. In the case of ultraviolet irradiation, the photographic material was exposed for 5 seconds to light from a 250 W super-high pressure mercury lamp disposed 50 cm away. The developing treatment after exposure was performed in quite the same manner as in Examples 25 to 51. Specifically, the photographic material was dipped in a developer solution for silver halide, washed with water, dipped in a developer for the copper compound, and then washed with water. The results obtained are shown in Table 11.

In Comparative Examples 9 to 11, the results were almost the same even when the photographic material was not dipped in the silver halide developing solution, but dipped only in the developer solution for the copper compound and washed with water (the treatment described in the above-cited U.S. Patents).

TABLE 11

| Comparative Example No. | Copper Complexes | Image Density/Fog Density: Exposure to Tungsten Lamp Light | Image Density/Fog Density: Exposure to Mercury Lamp Light |
|---|---|---|---|
| 9 | $Cu[P(C_6H_5)_3]_2BH_4$ | 0.02/0.02 | 0.30/0.05 |
| 10 | $Cu[P(OCH_3)_3]_4B(C_6H_5)_4$ | 0.03/0.03 | 0.85/0.04 |
| 11 | $Cu[H_2N(CH_2)_2NH_2]_2[B(C_6H_5)_4]_2$ | 0.02/0.02 | 0.25/0.10 |
| 12 | $Cu[P(C_6H_5)_3]_2BH_4$ (the photographic material of Example 25) | 1.65/0.25 | 1.80/0.02 |
| 13 | $Cu[P(OCH_3)_3]_4B(C_6H_5)_4$ (the photographic material of Example 32) | 1.75/0.15 | 1.65/0.15 |
| 14 | $Cu[H_2N(CH_2)_2NH_2]_2[B(C_6H_5)_4]_2$ (the photographic material of Example 35) | 2..0/0.20 | 1.95/0.15 |

It can be seen from the results obtained that the photographic materials of this invention are sensitive to light in the visible region, but the photographic materials disclosed in the above-cited U.S. Patents are not. Furthermore, the photographic materials of the invention have a higher sensitivity (or image density) to ultraviolet rays than the photographic materials of the U.S. Patents above cited.

While the invention has been described in detail and with reference to specific embodiments thereof, it will be apparent to one skilled in the art that various changes and modifications can be made therein without departing from the spirit and scope thereof.

What is claimed is:

1. A process for forming images, which comprises (1) exposing imagewise a photographic material comprising:

(a) a support, (b) a layer containing a salt or complex of monovalent or divalent copper and a hydrophilic binder formed on the support, and (c) a silver halide layer formed on layer (b);

(2) developing the silver halide layer using a chemical developer solution for silver halide; and (3) developing the layer (b) using an aqueous developing solution for layer (b) containing at least one reducing agent thereby to form a black non-silver image derived from layer (b) and containing copper at the site of the silver image formed in step (2).

2. The process of claim 1, wherein the developer for layer (b) has a pH of 4 to 14.

3. The process of claim 1, wherein the developing step (2) is carried out at a temperature of about 20° to about 80° C. for a period of about 30 seconds to about 20 minutes.

4. The process of claim 1, wherein the silver halide layer is a vacuum-deposited or sputtered silver halide layer.

5. The process of claim 1, wherein the silver halide layer is a silver halide emulsion layer.

6. The process of claim 1, wherein the copper salt or complex is at least one compound selected from compounds of the following formulae (1) to (3)

$$Cu_nX_mY_l.gCu_{n'}Z_{m'} \quad (1)$$

$$[Cu_nA_mB_l]X_l \quad (2)$$

$$M_rM'_s[Cu_nA_mB_2X_{m'}Y_l] \quad (3)$$

wherein n is an integer of 1 to 5; n' is an integer of 0 to 5, m, m', l, q, r and s each is an integer of 0 to 7 with the proviso that m and l are not 0 at the same time; l' is an integer of 1 to 10; X and Y each is an anion with a valence of 1 to 3; A and B each is a neutral molecule having the ability to coordinate as a Lewis base; Z is an anion with a valence of 1 to 3, a neutral molecule having the ability to coordinate as a Lewis base, or an element of Group VIa; and M and M' each is a cation with a valence of 1 to 3.

7. The process of claim 1, wherein in the general formulae (1) to (3),

X and Y each is selected from the group consisting an anion, including an anion with one or more remaining hydrogens, with a valence of 1 to 3 derived from sulfuric acid, nitric acid, hydrochloric acid, hydrofluoric acid, hydroiodic acid, hydrobromic acid, phosphoric acid, phosphorous acid, nitrous acid, sulfurous acid, thiosulfuric acid, carbonic acid, arsenic acid, boric acid, hydrogen cyanide, perchloric acid, perbromic acid, periodic acid, chromic acid, molybdic acid, hydrogen azide, hydrogen sulfide, selenic acid, telluric acid, tungstic acid, hypochlorous acid, hydrobroic acid and hydrogen thiocyanide; a hydroxyl ion; a boron tetrahydride ion; a boron cyanohydride ion; a tetraaryl boron ion in which the aryl group is a phenyl group or a phenyl group substituted with an alkyl group containing 1 to 5 carbon atoms; and an anion derived from a carboxylic acid of the formula $R^1(COOH)_p$ a sulfonic acid of the formula $R^2(SO_3H)_{p'}$ a $\beta$-diketone of the formula $R^3COCHR^4COR^5$, a phenol of the following formula

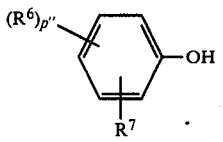

and a naphthol of the following formula

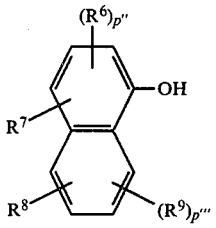

wherein $R^1$ represents a hydrogen atom or a straight-chain, branched-chain or cyclic alkyl group containing 1 to 25 carbon atoms or an aryl group with 1 to 3 rings; p is an integer of 1 to 6; $R^2$ represents a straight-chain, branched-chain, or cyclic alkyl group containing 11 to 18 carbon atoms, or an aryl group containing 1 to 3 rings; p' is an integer of 1 to 6; $R^3$ and $R^5$ each represents a straight-chain, branched chain or cyclic alkyl group containing 1 to 5 carbon atoms, an aryl group containing 1 to 3 rings, a furyl group, a thienyl group, an alkoxy group, or a hydrogen atom; $R^4$ represents a hydrogen atom, a straight-chain, branched chain or cyclic alkyl group containing 1 to 5 carbon atoms, an aryl group containing 1 to 3 rings, a halogen atom, a nitro group, or a thiocyano group; $R^6$ and $R^9$ each represents a formyl group, a carboxy group, an acetyl group, an amino group, a hydroxyamino group, an aminomethyl group, an aminoethyl group, a carbamoyl group, an N-aryl carbamoyl group with the aryl moiety containing 1 to 3 rings, an N-hydroxyiminomethine group, an N-aryl iminomethine group with the aryl moiety containing 1 to 3 rings, a hydroxyl group, a cyano group, a pyridyl group, an alkylpyridyl group with the alkyl moiety containing 1 to 5 carbon atoms, an aminophenyl group, a furyl group, an alkylfuryl group with the alkyl moiety containing 1 to 5 carbon atoms, a pyrrolyl group, an alkylpyrrolyl group with the alkyl moiety containing 1 to 5 carbon atoms, an imidazolyl group, an alkylimidazolyl group with the alkyl moiety containing 1 to 5 carbon atoms, a pyrazinyl group, an alkylpyrazinyl group with the alkyl moiety containing 1 to 5 carbon atoms, a pyrimidinyl group, a quinolinyl group, an isoquinolinyl group, a morpholinyl group, or a mercapto group; $R^7$ and $R^8$ each represents a straight-chain, branched-chain or cyclic alkyl group containing 1 to 25 carbon atoms, an aryl group containing 1 to 3 rings, a nitro group, a sulfonic acid group, an alkoxycarbonyl group with the alkoxy moiety containing 1 to 10 carbon atoms, or a hydrogen atom; and p'' and p''' each is an integer of 0 to 5;

A and B each is selected from the group consisting of straight-chain, branched-chain or cyclic alkylamines containing 1 to 25 carbon atoms and 1 to 4 amino groups, ammonium groups, imidazole, substituted imidazoles, pyrazole, substituted pyrazoles, pyridine, substituted pyridines, pyrazine, substituted pyrazines, pyrimidine, substituted pyrimidines, pyridazine, substituted pyridazines, indole, substituted indoles, purine, substituted purines, quinoline, substituted quinolines, isoquinoline, substituted isoquinolines, naphthyridine, substituted naphthyridines, quinoxaline, substituted quinoxalines, acridine, substituted acridines, thiophene, substituted thiophenes, benzothiophene, substituted benzothiophenes, naphthothiophene, substituted naphthothiophenes, thianthrene, and substituted thianthrenes, thioethers of the formula $R^{10}$-S-$R^{11}$ wherein $R^{10}$ and $R^{11}$ each represents a straight-chain, branched-chain or cyclic alkyl group containing 1 to 15 carbon atoms, or an aryl group containing 1 to 3 rings, phosphine compounds of the formula

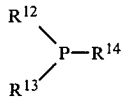

wherein $R^{12}$, $R^{13}$ and $R^{14}$ each represents a hydrogen atom, a straight-chain, branched-chain or cyclic alkyl group containing 1 to 15 carbon atoms, an aryl group containing 1 to 3 rings, an alkoxy group containing 1 to 15 carbon atoms, or an aryloxy group containing 1 to 3 rings, stibine compounds of the formula

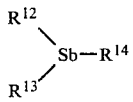

wherein $R^{12}$, $R^{13}$ and $R^{14}$ are the same as defined above, and nitriles of the formula

NC-$R^{15}$-CN wherein $R^{15}$ represents a straight-chain, branched-chain or cyclic divalent alkylene group containing 1 to 6 carbon atoms;

Z is selected from the group consisting of the members described above for X, Y, A and B, and oxygen, sulfur, selenium and tellurium atoms, and water; and M and M' each is selected from the group consisting of an ammonium ion, lithium, sodium, potassium, rubidium, magnesium ($Mg^{2\oplus}$), calcium, strontium, barium, aluminum, thallium ($Tl^{3\oplus}$), chromium ($Cr^{3\oplus}$), iron ($Fe^{2\oplus}$ and $Fe^{3\oplus}$), cobalt ($Co^{2\oplus}$ and $Co^{3\oplus}$), nickel ($Ni^{2\oplus}$ and $Ni^{3\oplus}$), palladium ($Pd^{2\oplus}$), platinum ($Pt^{2\oplus}$), silver, gold ($Au^{\oplus}$ and $Au^{3\oplus}$), zinc, cadmium and mercury ($Hg^{2\oplus}$) cations, and diazonium ions of the formula $ArN_2^{\oplus}$ wherein Ar represents a phenyl group.

8. The process of claim 1, wherein the copper salt or complex is at least one member selected from the group consisting of CuCl, CuBr, CuOH, CuCN, CuSCN, $Cu(NO_3)_2$, $CuSO_4$, $CuSO_3$, $Cu(HCOO)_2$, $Cu(CH_3COO)_2$, $Cu[CH_3(CH_2)_tCOO]_2$ wherein t is an integer of 1 to 16, $Cu(C_6H_5COO)_2$, $Cu_3(C_6H_5O_7)_2$ (copper citrate), $CuCl_2$, $Cu(OH)_2$, $CuBr_2$, $CuCl_2.Cu(OH)_2$, $Cu(ClO)_2$, $Cu(BrO_3)_2$, $Cu(ClO_4)_2$, $Cu(ClO_2)_2.3Cu(OH)_2$, $CuCO_3$, $CuCO_3.Cu(OH)_2$, CuI, $CuNO_3$, $Cu(NO_2)_3.3Cu(OH)_2$, $Cu_3(PO_4)_2$, $Cu_2S$, $CuS_4O_6$, $CuSO_4.3Cu(OH)_2$, $Cu_2Se$, $CuTeO_4$, $CuTeO_4$, $Cu_2WO_4.2CuWO_4$, $K_2[CuCl_2(H_2O)_2]Cl_2$, $K_2Cu(SO_4)_2$, $KCa[Cu(NO_2)_6]$, $K[Cu(S_2O_3)]$, $Na_3[Cu(S_2O_3)_2]$, $(NH_4)_2Cu(SO_4)_2$, $Cu(CH_3COO)$, $Cu(CH_3COO)_2.3CH_3COOK$, $Cu(CH_3COO)_2.3Cu(AsO_2)_2$, $(NH_4)_2[Cu(CH_3COO)_4]$, $Cu(BrCH_2COO)_2$, $Cu(C_6H_5COO)$, $Cu(C_{15}H_{31}COO)_2$, $Cu(C_{17}H_{35}COO)_2$, $Cu(C_{12}H_{25}COO)_2$, $Cu(C_{10}H_{21}COO)_2$, $Cu(C_3H_7COO)_2$, $Cu(C_6H_5C_{10}H_{20}COO)_2$, $Cu(C_2H_5C_6H_4COO)_2$, $Cu(OC_6H_4CHO)_2$, $Cu[CH_3CH(OH)COO]_2$, $Cu[CH_3CH(NH_2)COO]_2$, $Cu[HOCH_2CH(OH)COO]_2$, $Cu[OOCCH_2CH(NH_2)COO]$, $Cu[OOC(CHOH)_2COO]$, $Cu[ONC(CH_3)C(CH_3)NOH]_2$, $Cu(CH_3COCHCHCHO)_2$, $Cu[OOCCH(NH_2)CH_2CH_2COO]$, $Cu(CH_3COCHCOCH_3)_2$, $Cu(CH_3COCHCOOCH_3)_2$, $Cu(CF_3COCH_2COCH_3)_2$, $Cu(C_6H_5COCHCOCH_3)_2$, $Cu(C_6H_5COCHCOCF_3)_2$, $Cu(CH_3COC(C_6H_5)COCH_3)_2$, $Cu(CH_3COCBrCOCH_3)_2$, $Cu(CH_3COCCH_3COCH_3)_2$, $Cu(CH_3COCHCOOC_2H_5)_2$, $Cu[(CH_3CO)_2CCOOCH_3]_2$, $Cu[(CH_3COCHCOOC_2H_5)_2(NH_3)_2]$, $Cu(C_5H_4NCOO)_2$, $Cu[C_5H_3N(COO)_2]$, $Cu(NH_2C_6H_4SO_3)_2$, $Cu(HOC_6H_5SO_3)_2$, $Cu[(CH_3)_2CHCH_2CH(NH_2)COO]_2$, $Cu(C_6H_5CONH_2COO)_2$, $Cu[OOC(CH_2)_8COO]$, $Cu(OC_6H_4CH{=}NH)_2$, $Cu[OC_6H_3(NO_2)CH_2NH_2]_2$, $Cu[(CH_3)_2NCS_2]_2$, $Cu(NH_3)_2Cl_2$, $[Cu(NH_3)_2](NCS)_2$, $[Cu(C_5H_5N)_6]Cl_2$, $[Cu(C_5H_5N)_6](ClO_4)_2$, $[Cu(C_5H_5N)_6](NO_3)_2$, $\{Cu[(C_5H_4N)_2]_3\}Cl_2$, $\{Cu[(C_5H_4N)_2]_2\}(NO_3)_2$, $[Cu(H_2NCH_2CH_2NH_2)_2]Cl_2$, $[Cu(H_2NCH_2CH_2NH_2)_3]Cl_2$, $[Cu(H_2NCH_2CH_2NH_2)_2](ClO_4)_2$, $\{Cu[H_2N(CH_2)_4NH_2]\}_2(ClO_4)_2$, $[Cu(H_2NCH_2CH_2NH_2)_2].[B(C_6H_5)_4]_2$, $Cu[(H_2NCH_2COO)_2(H_2NCH_2CH_2NH_2)_2]$, $[Cu(CH_3CSNH_2)_4]Cl$, $[Cu(CH_3CSNH_2)_4]NO_3$, $[Cu(CH_3CSNH_2)_4]_2SO_4$, $[Cu(CH_3CSNH_2)_4Br$, $[Cu(CH_3SCH_2CH_2SCH_3)]Br$, $Cu(NO_3)_2.Cu(N_3)_2$, $Cu_2[OOC(CHOH)_2COO]$, $Cu(CH_3SCH_2CH_2SCH_3)Cl_2$,

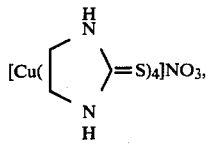

$Cu(C_6H_5CH_2SCH_2C_6H_5)_2Cl_2$, $\{Cu[HONC(CH_3)C(CH_3)NOH]_2\}Cl_2$, $\{Cu[HONC(CH_3)C(CH_3)NOH]_2\}SO_4$, $[2CuCl.CH_3N{=}NCH_3].CuC_2O_4$, $\{Cu[(C_2H_5O)_3P]_3NO_3$, $\{Cu[(C_6H_5O)_3P]_3\}Cl$, $\{Cu[(C_6H_5O)_3P]_2\}BH_4$, $\{Cu[(C_2H_5O)_3P]_2\}BH_4$, $\{Cu[(C_2H_5O)_2P]_2\}BH_3CN$, $\{Cu[(C_6H_5)_3P]_2\}BH_4$, $\{Cu[(C_6H_5)_3P]_2\}BH_3CN$, $\{Cu[(CH_3C_6H_4)_3P]_3\}BH_3CN$, $\{Cu[(C_6H_5)_3Sb]_3\}NO_3$, $\{Cu[(C_6H_5)_3Sb]_3\}BH_3CN$, $Cu(NCCH_2CN)_2NO_3$, $Cu[NC(CH_2)_2CN]_2NO_3$, $Cu[NC(CH_2)_3CN]_2NO_3$, $Cu[NC(CH_2)_4CN]NO_3$, $Cu[NC(CH_2)_5CN]_2NO_3$, $Cu[C_6H_4(CN)_2]_2NO_3$,

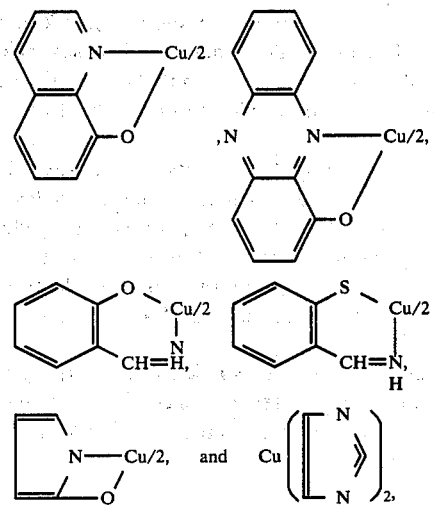

$Cu(HOC_6H_4COO)_2$, $Cu[C_6H_{13}(OH)_2COO]_2$, $Cu(CH_3C_6H_4COO)_2$, $Cu(CH_3COCH_3COCH_3)_2$, $Cu(CF_3\ COCHCOCH_3)_2$,

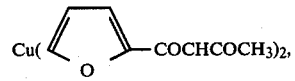

$Cu[OOC(CH_2)_uCOO]$ wherein u is an integer of 1 to 8, $Cu(NH_3)_2Cl_2$, $[Cu(NH_3)_2](NCS)_2$, $[Cu(H_2NCH_2CH_2NH_2)_2]Cl_2$, $[Cu(H_2NCH_2CH_2NH_2)_2]Br_2$, $[Cu(H_2NCH_2CH_2NH_2)_2][B(C_6H_5)_4]_2$, $[Cu(H_2NCH_2CH_2NH_2)_2](NO_3)_2$, $[Cu(H_2NCH_2CH_2NH_2)_2]SO_4$, $[Cu(C_5H_5N)_2]Cl_2$, $[Cu(C_5H_5N)_2]Br_2$, $Cu[NC(CH_2)_vCN]_2NO_3$ wherein v is an integer of 1 to 8, $Cu[C_6H_4(CN)_2]_2NO_3$, $Cu[P(C_6H_5)_3]_2BH_4$, $Cu[P(C_6H_4CH_3)_3]_2BH_4$, $Cu[P(C_6H_5)_3]_3BH_3CN$, $Cu[P(C_6H_5)_3]_2NO_3$, $Cu[P(C_6H_5)_3]_4B(C_6H_5)_4$, $Cu[P(C_6H_5)_3]_2Cl$, $Cu[Sb(C_6H_5)_3]_3BH_3CN$, $Cu[Sb(C_6H_5)_3]_3Cl$, $Cu[P(OCH_3)_3]_4B(C_6H_5)_4$, and $Cu[P(OCH_3)_3]_3BH_3CN$.

9. The process of claim 1, wherein the copper salt or complex is present in an amount of about 5 to about 60 parts by weight per 100 parts by weight of the hydrophilic binder.

10. The process of claim 1, wherein the hydrophilic binder has a molecular weight of about 5,000 to about 300,000 and is selected from the group consisting of cellulose acetate having a degree of acetylation of 40 to 60%, gelatin, carboxymethyl cellulose, polyvinyl alcohol, polyvinyl pyrrolidone and polyacrylamide.

11. The process of claim 1, wherein the support has a thickness of about 10 μm to about 2 mm and is at least one member selected from the group consisting of polyethylene terephthalate sheetlike materials, polyamide sheet-like materials, nylon sheet-like materials, triacetyl cellulose sheet-like materials, baryta paper, coated papers, resin-finished papers, synthetic paper-like sheets, wooden plates, metal plates and glass sheets.

12. The process of claim 1, wherein layer (b) has a thickness of about 1 μm to about 100 μm.

13. The process of claim 1, wherein the silver halide is at least one member selected from the group consisting of silver chloride, silver bromide, silver chlorobromide with a silver chloride content of about 2 to about 98 mole %, silver iodobromide with a silver iodide content of about 1 to about 10 mole %, and silver chloroiodide with a silver iodide content of about 1 to about 10 mole %.

14. The process of claim 1, wherein the silver halide emulsion layer contains a binder which is at least one member selected from the group consisting of gelatin, a gelatin derivative, carboxymethyl cellulose, polyvinyl alcohol, polyvinyl pyrrolidone, polyacrylamide and cellulose acetate with a degree of acetylation of 40 to 60%.

15. The process of claim 1, wherein the silver halide layer contains about 0.005 to 1 g of silver halide calculated as metallic silver per square meter of the photographic material.

16. The process of claim 5, wherein the silver halide emulsion layer has a thickness of about 0.1 μm to about 20 μm.

17. The process of claim 1, wherein the development of the silver halide layer and layer (b) is performed simultaneously in one developing solution.

18. The process of claim 1, wherein the development of the silver halide layer and layer (b) is performed successively by developing the silver halide layer in one chemical developing solution, fixing the developed silver halide layer, and then developing layer (b) in a different developing solution.

19. The process of claim 1, wherein the aqueous developer solution for the layer (b) has a concentration of said reducing agent from about 1 to about 15% by weight based on water.

20. The process of claim 1, wherein the reducing agent is paraformaldehyde, dimethylamineborane, sodium borohydride, L-asocorbic acid or sodium dithionite ($Na_2S_2O_4$).

21. The process of claim 1 wherein the black non-silver image contains copper (II) oxide at the site of the silver image formed in step (2).

22. The process of claim 1, wherein said silver halide layer is a vacuum deposited or sputter etched layer and said black non-silver image contains copper II oxide.

* * * * *